US005653866A

United States Patent [19]

Jessup et al.

[11] Patent Number: 5,653,866

[45] Date of Patent: Aug. 5, 1997

[54] GASOLINE FUEL

[75] Inventors: Peter J. Jessup; Michael C. Croudace, both of Santa Ana, Calif.

[73] Assignee: Union Oil Company of California, El Segundo, Calif.

[21] Appl. No.: 464,554

[22] Filed: Jun. 5, 1995

Related U.S. Application Data

[63] Continuation of Ser. No. 409,074, Mar. 22, 1995, Pat. No. 5,593,567, which is a continuation of Ser. No. 77,243, Jun. 14, 1993, abandoned, which is a division of Ser. No. 628,488, Dec. 13, 1990, Pat. No. 5,288,393.

[51] Int. Cl.[6] ..... C10L 1/04

[52] U.S. Cl. ..... 208/46; 208/16; 208/14; 208/18; 123/1 A; 585/14

[58] Field of Search ..... 123/1 A; 208/46, 208/14–18; 585/14

[56] References Cited

U.S. PATENT DOCUMENTS

| | | | |
|---|---|---|---|
| H1305 | 5/1994 | Townsend et al. | 44/449 |
| Re. 20,596 | 12/1937 | Taylor et al. . | |
| 1,409,404 | 3/1922 | Ramage . | |
| 2,032,330 | 2/1936 | Roberts et al. | 196/11 |
| 2,142,937 | 1/1939 | Deanesly et al. . | |
| 2,190,480 | 2/1940 | Nichols, Jr. et al. . | |
| 2,204,215 | 6/1940 | Greensfelder et al. . | |
| 2,209,904 | 7/1940 | McCulloch et al. | 44/9 |
| 2,401,983 | 6/1946 | Stanly et al. . | |
| 2,407,716 | 9/1946 | Marschner . | |
| 2,407,717 | 9/1946 | Marschner . | |
| 2,409,157 | 10/1946 | Schulze et al. . | |
| 2,411,582 | 11/1946 | McCulloch . | |
| 2,495,648 | 1/1950 | Voge et al. . | |
| 2,593,561 | 4/1952 | Herbst et al. | 44/69 |
| 2,857,254 | 10/1958 | Thomas | 44/63 |
| 2,939,836 | 6/1960 | Koome et al. . | |
| 2,944,003 | 7/1960 | Ritedisnlj et al. . | |
| 2,968,609 | 1/1961 | Lutz | 208/100 |
| 3,002,917 | 10/1961 | Hamilton | 208/79 |
| 3,009,789 | 11/1961 | Jordan et al. . | |
| 3,009,791 | 11/1961 | Emrick . | |
| 3,034,878 | 5/1962 | McCall et al. . | |
| 3,156,640 | 11/1964 | Hart . | |
| 3,385,680 | 5/1968 | Feld et al. . | |
| 3,391,077 | 7/1968 | Obsorne | 208/256 |
| 3,658,690 | 4/1972 | Graven . | |
| 3,685,502 | 8/1972 | Oberdorfer, Jr. | 123/119 X |
| 3,753,670 | 8/1973 | Strang et al. | 44/432 |
| 3,758,401 | 9/1973 | Bridgeford et al. | 208/78 |
| 3,765,848 | 10/1973 | Brent | 44/51 |
| 3,785,790 | 1/1974 | Strang | 44/66 |
| 3,836,342 | 9/1974 | Shang et al. . | |
| 3,873,276 | 3/1975 | Haemmerle et al. | 44/63 |
| 3,886,759 | 6/1975 | McNamee . | |
| 3,894,849 | 7/1975 | Polss . | |
| 3,902,870 | 9/1975 | Rollmann et al. | 44/56 |
| 3,903,194 | 9/1975 | Hutson, Jr. et al. . | |
| 3,904,508 | 9/1975 | Whyte, Jr. et al. . | |
| 3,920,698 | 11/1975 | Haemmerle et al. | 44/63 |
| 3,955,938 | 5/1976 | Graham et al. | 44/305 |
| 3,957,901 | 5/1976 | Chapman . | |
| 3,980,448 | 9/1976 | Haemmerle et al. | 44/63 |
| 3,988,122 | 10/1976 | Rosenthal et al. | 44/452 |
| 4,017,268 | 4/1977 | Gilley | 44/52 |
| 4,022,589 | 5/1977 | Alquist et al. . | |
| 4,045,092 | 8/1977 | Keller | 302/66 |
| 4,112,889 | 9/1978 | Harpman | 123/25 B |
| 4,118,425 | 10/1978 | Herbetman . | |
| 4,180,036 | 12/1979 | Wolf | 123/122 E |
| 4,194,886 | 3/1980 | Ripple | 44/70 |
| 4,205,960 | 6/1980 | Bryant | 44/68 |
| 4,211,639 | 7/1980 | Jackson | 208/188 |
| 4,214,876 | 7/1980 | Garth et al. | 44/404 |
| 4,215,997 | 8/1980 | Sandy | 44/367 |
| 4,220,120 | 9/1980 | Jackson et al. . | |
| 4,231,756 | 11/1980 | King | 44/53 |
| 4,244,703 | 1/1981 | Kespaul | 44/56 |
| 4,294,587 | 10/1981 | Burns . | |
| 4,295,861 | 10/1981 | Burns . | |

(List continued on next page.)

FOREIGN PATENT DOCUMENTS

| | | | |
|---|---|---|---|
| 213136 | 5/1952 | Australia | 208/17 |
| 466511A | 1/1991 | European Pat. Off. . | |

OTHER PUBLICATIONS

Hydrocarbon Conrol For La by Red Gasoline Volatility.

"Carbon Monoxide Linked to Heart Failure in Elderly," The Orange County Register, Oct. 10, 1995, one page.

"Southland Smog: Causes and Effects," the South Coast Air Quality Management District, two pages.

"CARB Says Phase 2 RFG Reduces Cancer Risk by 30%–40%," *Octane Week*, Sep. 18, 1995, p. 8.

Testimony, Dr. Robert Zweig, Meeting of California Air Resources Board, Nov. 21, 1991, Transcript pp. i, ii, 129–134 and 353.

Morton Lippmann, "Health Effects of Ozone: A Critical Review," *The Journal of the Air & Waste Management Association*, vol. 39, No. 5, May 1989, pp. 672–695.

"Health Effects of Ozone: Critical Review Discussion Papers," *The Journal of the Air & Waste Management Association*, vol. 39, No. 9, Sep. 1989, pp. 1185–1194.

F. L. Potter, "Clean Air Act History Marked by Battle, Compromise," *Fuel Reformulation*, vol. 1, No. 1, Sep./Oct. 1991, pp. 22–25.

J. E. Peeples, "A Brave New World for Fuel Reformulation," *Fuel Reformulation*, vol. 1, No. 1, Sep./Oct. 1991, pp. 27–31.

"EPA Administrator Points to Reformulated Fuels for Clean Air," *Octane Week*, vol. V, No. 6, Jun. 18, 1990, pp. 1 and 8.

(List continued on next page.)

*Primary Examiner*—Helane E. Myers
*Attorney, Agent, or Firm*—Gregory F. Wirzbicki

[57] ABSTRACT

By controlling one or more properties of a gasoline fuel suitable for combustion in automobiles, the emissions of NOx, CO and/or hydrocarbons can be reduced. The preferred fuel for reducing all three such emissions has a Reid Vapor Pressure no greater than 7.5 psi (0.51 atm), essentially zero olefins, and a 50% D-86 Distillation Point greater than about 180° F. (82° C.) but less than 205° F. (96.1° C.)

58 Claims, 9 Drawing Sheets

U.S. PATENT DOCUMENTS

| | | | |
|---|---|---|---|
| 4,684,373 | 8/1987 | Vataru et al. | 44/63 |
| 4,699,629 | 10/1987 | Croudace et al. | 44/429 |
| 4,720,288 | 1/1988 | Croudace et al. . | |
| 4,737,159 | 4/1988 | Phillips | 44/419 |
| 4,295,862 | 10/1981 | Burns . | |
| 4,297,172 | 10/1981 | Kyle | 203/19 |
| 4,312,636 | 1/1982 | Singerman | 44/447 |
| 4,313,738 | 2/1982 | Parlman et al. . | |
| 4,319,981 | 3/1982 | Singerman | 44/447 |
| 4,321,061 | 3/1982 | Parlman . | |
| 4,321,063 | 3/1982 | Burns . | |
| 4,322,304 | 3/1982 | Parlman et al. . | |
| 4,324,569 | 4/1982 | Klimczak . | |
| 4,336,032 | 6/1982 | Kupka et al. | 44/56 |
| 4,339,245 | 7/1982 | Burns . | |
| 4,341,529 | 7/1982 | Burns . | |
| 4,347,062 | 8/1982 | Born et al. | 44/68 |
| 4,372,752 | 2/1983 | Lamy . | |
| 4,378,230 | 3/1983 | Rhee | 44/51 |
| 4,378,231 | 3/1983 | Burns . | |
| 4,387,257 | 6/1983 | Burns | 585/14 |
| 4,388,081 | 6/1983 | Burns | 44/443 |
| 4,417,904 | 11/1983 | Burns et al. . | |
| 4,420,930 | 12/1983 | Beuther et al. | 60/39 |
| 4,429,173 | 1/1984 | Hutson et al. . | |
| 4,437,436 | 3/1984 | Pfefferle | 123/1 A |
| 4,444,567 | 4/1984 | Burns et al. . | |
| 4,455,909 | 6/1984 | Burns . | |
| 4,468,233 | 8/1984 | Bruderreck et al. . | |
| 4,474,580 | 10/1984 | MacKenzie et al. | 44/68 |
| 4,501,596 | 2/1985 | Burns | 44/341 |
| 4,508,617 | 4/1985 | Montgomery . | |
| 4,525,174 | 6/1985 | Croudace . | |
| 4,571,439 | 2/1986 | Keyworth . | |
| 4,579,990 | 4/1986 | Keyworth . | |
| 4,600,408 | 7/1986 | Jessup et al. . | |
| 4,602,919 | 7/1986 | Jessup et al. . | |
| 4,607,129 | 8/1986 | Lee . | |
| 4,647,292 | 3/1987 | Jessup et al. . | |
| 4,647,368 | 3/1987 | McGuiness et al. . | |
| 4,743,273 | 5/1988 | Croudace et al. | 44/418 |
| 4,773,916 | 9/1988 | Croudace et al. | 44/440 |
| 4,781,728 | 11/1988 | Jessup et al. . | |
| 4,797,134 | 1/1989 | Vataru | 44/66 |
| 4,804,389 | 2/1989 | Johnston et al. | 44/70 |
| 4,812,146 | 3/1989 | Jessup | 585/14 |
| 4,818,250 | 4/1989 | Whitworth . | |
| 4,824,552 | 4/1989 | Nagasawa | 208/17 |
| 4,846,717 | 7/1989 | Croudace et al. | 44/418 |
| 4,851,601 | 7/1989 | Fukuda et al. . | |
| 4,852,992 | 8/1989 | Nasu | 44/50 |
| 4,873,389 | 10/1989 | Avidan et al. . | |
| 4,884,531 | 12/1989 | Degnan, Jr. et al. . | |
| 4,895,640 | 1/1990 | Jackson | 208/188 |
| 4,896,636 | 1/1990 | Graiffe | 123/1 A |
| 4,899,014 | 2/1990 | Avidan et al. . | |
| 4,953,332 | 9/1990 | Talbert . | |
| 5,004,850 | 4/1991 | Wilson | 585/1 |
| 5,015,356 | 5/1991 | Talbert . | |
| 5,032,144 | 7/1991 | Jessup et al. | 44/384 |
| 5,041,208 | 8/1991 | Patridge et al. . | |
| 5,113,803 | 5/1992 | Hollrah et al. | 123/1 A |

OTHER PUBLICATIONS

"Clean Air Act Now Law; Refiners Busy Responding," *Octane Week*, vol. V, No. 27, Nov. 19, 1990, pp. 1, 4, and 6.

"API: Industry 'Committed,' But Emissions Data Lacking," *Octane Week*, vol. V, No. 25, Nov. 5, 1990, pp. 1, 7 and 8.

"Air Quality Designations and Classifications; Final Rule," Environmental Protection Agency, *Federal Register*, vol. 56, No. 215, Nov. 6, 1991, pp. 56695–46858.

"Status of State Actions Regarding Ozone Nonattainment Areas: Likely Motor Fuels Options to be Submitted in State Implementation Programs," *Octane Week*, Nov. 8, 1993, pp. 7–8.

R. A. Corbett, "Auto/Oil Progressing Toward Cleaner Fuel Compositions," *Fuel Reformulation*, vol. 1, No. 1, Sep./Oct. 1991, pp. 46–50.

J. J. Wise, "Auto/Oil Program —Data and Knowledge —Growing Rapidly," *Fuel Reformulation*, vol. 2, No.3, May/Jun. 1992, pp. 64–69.

R. H. Pahl and M. J. McNally, "Fuel Blending and Analysis for the Auto/Oil Air Quality Improvement Research Program," *SAE Technical Paper Series*, 902098, International Fuels and Lubricants Meeting and Exposition, Tulsa, Oklahoma, Oct. 22–25, pp. 1–11.

"Phase II of Auto/Oil Will Include CNG, 'M100'," *Octane Week*, vol. V, No. 27, Nov. 19, 1990, pp. 1 and 3.

"Emissions from Methanol Fuels and Reformulated Gasoline in 1993 Production Flexible/Variable Fuel and Gasoline Vehicles," Auto/Oil Air Quality Improvement Research Program, *Technical Bulletin No. 13*, Aug. 1994.

"Auto/Oil Group Set to Release First Batch of Test Data," *Octane Week*, vol. V, No. 31, Dec. 17, 1990, pp. 1 & 4.

W. J. Koehl, J. D. Benson, V. Burns, R. A. Gorse, A. M. Hochhauser, and R. H. Reuter, "Effects of Gasoline Composition and Properties on Vehicle Emissions: A Review of Prior Studies —Auto/Oil".

"Air Quality Improvement Research Program," *SAE Technical Paper Series*, 91321, International Fuels and Lubricants Meeting and Exposition, Toronto, Canada, Oct. 7–10, 1991, pp. 1–33.

D. R. Lawson, P. J. Groblicki, D. H. Stedman, G. A. Bishop and P. L. Guenther, "Emissions from In–Use Motor Vehicles in Los Angeles: A Pilot Study of Remote Sensing and the Inspection and Maintenance Program," *Journal of the Air & Waste Management Association*, vol. 40, No. 8, Aug. 1990, pp. 1096–1105.

"1994 Air Quality," South Coast Air Quality Management District, two pages.

"Reformulated Gasoline: Proposed Phase 1 Specifications," Technical Support Document, California Air Resources Board, Aug. 13, 1990.

W. J. Piel and R. X. Thomas, "Oxygenates for Reformulated Gasoline," *Hydrocarbon Processing*, Jul. 1990, pp. 68–73.

W. J. Piel, "Ethers Will Play Key Role in 'Clean' Gasoline Blends," *Oil & Gas Journal*, Dec. 4, 1989, pp. 40–43.

B. H. Eccleston and R. W. Hurn, "Comparative Emissions From Some Leaded and Prototype Lead–Free Automobile Fuels," United States Department of the Interior, Bureau of Mines, *Report of Investigations 7390*, 1970, pp. 1–24.

R. K. Stone and B. H. Eccleston, "Vehicle Emissions vs. Fuel Composition," API–Bureau of Mines–Part II, 1969, pp. 651–690.

"Motor–Fuel Composition and Photochemical Smog," *API Publication 4247*, Final Report (Part I), Apr. 1975.

"Motor–Fuel Composition and Photochemical Smog," *API Publication 4247*, Reference Data Report (Part 2), Apr. 1975.

W. F. Marshall and M. D. Gurney, "Effect of Gasoline Composition on Emissions of Aromatic Hydrocarbons," *SAE Technical Paper Series,* 892076, International Fuels and Lubricants Meeting and Exposition, Baltimore, Maryland, Sep. 25–28, 1989, pp. 1–10.

"Gasoline Consumption by State, 1991," *National Petroleum News,* vol. 84, No. 7, Mid–Jun. 1992, p. 94.

Niper (National Institute for Petroleum and Energy Research) computer data regarding properties of summer gasolines from 1976–86& 88–90 (688 pages).

ASTM D 323 –89 "Standard Test Method for Vapor Pressure of Petroleum Products (Reid Method)".

ASTM D–86 —82 "Standard Method for Distillation of Petroleum Products".

ASTM D 4814 —89 "Standard Specification of Automotive Spark–Ignition Engine Fuel".

40 CFR Part 86, Subpart B, "Emission Regulations for 1977 and Later Model Year New Light–Duty Vehicles and New Light–Duty Trucks; Test Procedures".

Brown, J. E., Greenlee, K. W., Tindall, E. M., "*Octane Numbers of Pure Hydrocarbon Blends and Their Relationship to Precombustion Reactions,*" American Petroleum Institute's Division of Refining, vol. 42, [III] (1962).

Fleming, R. D., Eccleston, D. G., "*The Effect of Fuel Composition, Equivalence Ratio, and Mixture Temperature on Exhaust Emissions,*" SAE Technical Paper Series, 710012, Automotive Engineering Congress, Detroit, Michigan, Jan. 11–15, 1971.

Zaghini, N., Mangolini, S., Arteconi, M., and Sezzi, F., "*Polynuclear Aromatic Hydrocarbons In Vehicle Exhaust Gas,*" SAE Technical Paper Series, 730836, National Combined Farm, Construction & Industrial Machinery and Fuels and Lubricants Meetings, Milwaukee, Wisconsin, Sep. 10–13, 1973.

Morris, W. E., "*The Interaction Approach to Gasoline Blending,*" presented at the National Petroleum Refiners Association Annual Meeting, San Antonio, Texas, Mar. 23–25, 1975.

Knaus, J. A., Lockerbie, T. E., Buerstetta, F. D., and Warren, T. W., "*Road Octane Improvement —A Basis for Process Evaluation,*" presented at the Thirteenth Southwest Regional Meeting of the American Chemical Society, Tulsa, Oklahoma, Dec. 5–7, 1957.

Anglo–Iranian Oil Co., Ltd. et al., "*High–Octane Aviation Fuel by the Sulfuric–Acid Alkylation Process,*" presented at the Twentieth Annual Meeting of the American Petroleum Institute in Chicago, Illinois, Nov. 9–17, 1939.

Carr, R. C., Starkman, E. S., and Sawyer, R. F., "*The Influence of Fuel Composition on Emissions of Carbon Monoxide and Oxides of Nitrogen,*" SAE Technical Paper Series, 700470, Mid–Year Meeting, Detroit, Michigan, May 18–22, 1970.

Davis, N. P., Uyehara, O. A., and Myers, P. S., "*The Effects of Knock On The Hydrocarbon Emissions Of A Spark–Ignition Engine,*" SAE Technical Paper Series, 690085, International Automotive Engineering Congress, Detroit, Michigan, Jan. 13–17, 1969.

Duke, L. C., Lestz, S. S., and Meyer, W. E., "*The Relation Between Knock and Exhaust Emissions Of A Spark Ignition Engine,*" SAE Technical Paper Series, 700062, Automotive Engineering Congress, Detroit, Michigan, Jan. 12–16, 1970.

Nelson, E. E., "*Hydrocarbon Control For Los Angeles By Reducing Gasoline Volatility,*" SAE Technical Paper Series, 690087, International Automotive Engineering Congress, Detroit, Michigan, Jan. 13–17, 1969.

Mulac, J. C., McFafferty, R. L., and Meyer, W.A.P., "*Carburetor Evaporation Losses —Volatility and Reactivity,*" presented at the 31st Mid–Year Meeting of the American Petroleum Institute's Division of Refining, Houston, Texas, May 11, 1966.

McKinney, C. M. and Blade, O. C., "*Bureau of Mines —API Survey of Aviation Gasolines, 1969,*" SAE Technical Paper Series, 700228, National Business Aircraft Meeting, Wichita, Kansas, Mar. 18–20, 1970.

Adams. F. H., "*New Technology Complements An Aliphatic Route to Future Gasolines,*38 Proceedings of the American Petroleum Institute's Division of Refining, 1973. Presented at the 38th Mid–Year Meeting of the American Petroleum Institute's Division of Refining", Philadelphia, Pa., May 14–17, 1973.

"*Is Reformulated Gasoline A 'New' Gasoline,* EPA–Office of Mobile Sources, Technical Overview", EPA 420–F–95, Apr. 1995.

Zwicker, S. L., "*Vapor Emission Controls,*" National Petroleum Refiners Association, FL–85–89. Presented at the 1985 Fuels & Lubricants Meeting, Houston, Texas, Nov. 7–8, 1985.

Oberfell, G. G. et al., "*Thermal Alkylation and Neohexane,*" presented at the Twentieth Annual Meeting of the American Petroleum Institute, Chicago, Illinois, Nov. 9–17, 1939.

Duffy, L. J., Everett, N. R., Sevcik, J. J., and Piehle, F. J., "*Keeping The Lead Out of Unleaded Gasolines,*" Proceedings of the American Petroleum Institute's Division of Refining, 1972.

Presented at the 37th Mid–Year Meeting of the American Petroleum Institute's Division of Refining, New York, New York, May 8–11, 1972.

Gibbs, L. M., "*The Impact of ASTM Specifications On State Motor Fuel Regulations,*" Proceedings of the American Petroleum Institute's Division of Refining, 1986. Presented at the 51st Mid–Year Meeting of the American Petroleum Institute's Refining Department, San Diego, California, May 12–15, 1986.

Croudace, M. C. and Jessup, P. J., "*Studies of Octane Properties of Mixtures of Isomeric Hexanes,*" SaE Technical Paper Series, 881604, International Fuels and Lubricants Meeting and Exposition, Portland, Oregon, Oct. 10–13, 1988.

Pendelton, P. O., "*Automotive Gasoline Usage in Reciprocating Aircraft Engines,*" SAE Technical Paper Series, 871012, General Aviation Aircraft Meeting and Exposition, Wichita, Kansas, Apr. 28–30, 1987.

File History for U.S. Patent Re. 20,596, Taylor et al., Process for Manufacturing Motor Fuel, Dec. 21, 1937.

File History for U.S. Pat. No. 2,401,983 Stanly et al. Motor Fuels, Jun. 11, 1946.

File History for U.S. Pat. No. 2,142,937, Deanesly et al., Production of Higher Boiling Hydrocarbons from Olefins, Jan. 3, 1939.

File History of U.S. Pat. No. 2,204,215, Greensfelder et al., Manufacture of Motor Fuel, Jun. 11, 1940.

File History of U.S. Pat. No. 2,407,716, Marschner, Superfuel, Sep. 17, 1946.

File History of U.S. Pat. No. 2,407,717, Marschner, Aviation Superfuel, Sep. 17, 1946.

File History of U.S. Pat. No. 2,411,582, McCulloch, Aviation Fuel, Nov. 26, 1946.

File History of U.S. Pat. No. 2,495,648, Voge et al., Hydrocarbon Treating Process, Jan. 24, 1950.

File History of U.S. Pat. No. 2,939,836, Koome et al., Destructive Hydrogenation of Heavy Cycle Oils, Jun. 7, 1960.

File History of U.S. Pat. No. 2,944,003, Ruedisulj et al., Production of Aviation Gasoline, Jul. 5, 1960.

File History of U.S. Pat. No. 3,156,640, Hart, Combined Hydroisomerization–Desulfurization Process, Nov. 10, 1964.

File History of U.S. Pat. No. 4,429,173, Hutson, Jr. et al., Production of High–Octane Unleaded Motor Fuel by Alkylation of Isobutane with Isomylenes Obtained by Dehydrogenation of Isopentane, Jan. 31, 1984. File History includes copies of 15 patents cited during prosecution.

File History of U.S. Pat. No. 4,525,174, Croudace, Method and Fuel Composition for Control of Octane Requirement Increase, Jun. 25, 1985.

File History of U.S. Pat. No. 4,600,408, Jessup et al., Gasoline Compositions Containing Carbonates, Jul. 15, 1986.

File History of U.S. Pat. No. 4,602,919, Jessup et al., Gasoline Compositions Containing Malonates, Jul. 29, 1986.

File History of U.S. Pat. No. 4,647,292, Jessup et al., Gasoline Composition Containing Acid Anhydrides, Mar. 3, 1987.

File History of U.S. Pat. No. 4,699,629, Croudace et al., Fuel Composition and Method for Control of Octane Requirement Increase, Oct. 13, 1987.

File History of U.S. Pat. No. 4,720,288, Croudace et al., Gasoline Fuel Composition, Jan. 19, 1988.

File History of U.S. Pat. No. 4,743,273, Croudace et al., Fuel Compositon and Method for Control of Engine Octane Requirements, May 10, 1988.

File History of U.S. Pat. No. 4,773,916, Croudace et al., Fuel Composition and Method for Control of Octane Requirement Increase, Sep. 27, 1988.

File History of U.S. Pat. No. 4,781,728, Jessup et al., Octane Enhancers for Fuel Compositions, Nov. 1, 1988.

File History of U.S. Pat. No. 4,812,146, Jessup, Liquid Fuels of High Octane Values, Mar. 14, 1989.

File History of U.S. Pat. No. 4,844,717, Croudace et al., Fuel Composition and Method for Control of Engine Octane Requirements, Jul. 4, 1989.

File History of U.S. Pat. No. 5,032,144, Jessup et al., Octane Enhancers for Fuel Compositions, Jul. 16, 1991.

Civil Docket for Case #95–CV–2379, U.S. District Court, Central District of California ASTM D 1319–89 "Standard Test Method for Hydrocarbon Types in Liquid Petroleum Products by Fluorescent Indicator Adsorption".

"An Overview of Unocal's Low Emission Gasoline Research Program" by P. J. Jessup et al., SAE 920801, Feb. 24–28, 1992.

U.S. Pat. No. 3,795,495 issued to Howland et al. on Mar. 5, 1974. "New Gas for Older Cars Will Cut Air Pollution," *Chemical & Engineering News,* Aug. 21, 1989, p. 8.

"The Role of MTBE in Future Gasoline Production" By William J. Piel, *Energy Progress* (vol. 8, No. 4), Dec., 1988, pp. 201–204.

"Are the Reductions in Vehicle Carbon Monoxide Exhaust Emissions Proportional to the Fuel Oxygen Content?" by J. A. Gething, J. S. Swistand, and J. C. Horn, *SAE Technical Paper Series,* 890216, SAE International Congress and Exposition, Detroit, Michigan, Feb. 17–Mar. 3,1989.

"How Injector, Engine, and Fuel Variables Impact Smoke and Hydrocarbon Emissions with Port Fuel Injection" by Ather A. Quader, *SAE Technical Paper Series,* 890623 SAE International Congress and Exposition, Detroit, Michigan, Feb. 27–Mar. 3, 1989.

"Engine Bench Evaluation of Gasoline Composition Effect on Pollutants Conversion Rate by a Three–Way Catalyst" by Michel F. Prigent, Brigitte C. Martin and Jean–Claude Guibet, *SAE Technical Paper Serial,* 900153, SAE International Congress and Exposition, Detroit, Michigan, Feb. 26–Mar. 2, 1990.

"Effect on Gasoline Quality on Throttle Response of Engines During Warm–up" by Minoru Tomita, Masanori Okada, Haruyuki Katayama and Masahiko Nakada, *SAE Technical Paper Series,* 900163, SAE International Congress and Exposition, Detroit, Michigan, Feb. 26–Mar. 2, 1990.

"The Effect of Gasoline Aromatics Content on Exhaust Emissions: A Cooperative Test Program" by Jeff A. Gething, S. Kent Hoekman, *SAE Technical Paper Series,* 902073, International Fuels and Lubricants Meeting and Exposition, Tulsa, Oklahoma, Oct. 22–25, 1990.

*Octane Week,* Special NPRA Convention Edition, Week of Mar. 26, 1990, vol. IV, No. 44, pp. 1–14.

"Automotive Fuels for the 1990's —Challenges and Opportunities" by Joseph M. Colucci, Research Publication, General Motors Research Laboratories, GMR–6589, F&L–882 to be presented at DeWitt and Company —Petrochemical Review Seminar, Houston, TX, Mar. 30, 1989.

"MTBE —The Refiner's Key to Future Gasoline Production" by William J. Piel, National Petroleum Refiners Association, AM–88–66, 1988 Annual NPRA Meeting, San Antonio, Texas, Mar. 20–22, 1988.

"Vehicle Evaporative and Exhaust Emissions as Influenced by Benzene Content of Gasoline" by Donald E. Seizinger, William F. Marshall, Frank W. Cox, and Martin W. Boyd, National Institute for Petroleum and Energy Research, NIPER–151, DE86 010603, Apr. 16, 1986.

"The Effect of Aromatics Content on NOx Emissions" by Annette Reid Guerrero and James M. Lyons, Toxics and Fuels Section, Mobile Source Division, California Air Resources Board, Mar., 1990.

"The Effect of Gasoline Aromatics on Emissions of Nitrogen Oxides in Vehicle Exhaust", by J. A. Gething, Chevron Research and Technology Company, Richmond, CA Apr. 19, 1990.

"Reformulated Gas No Help in Older Cars" by Matthew L. Wald, The New York Times, appearing in Orange County Register, Dec. 19, 1990.

"Clean Gasoline" ARCO ECl–Gasoline Nationwide Gasoline Compositions (KVMA And SwRI Surveys, 1988).

"Reformulated Gasoline" Industry Scoreboard Regular Compositions Average Results for 9 RVP Season.

"Premium Compositions" Average Results for 9 RVP Season.

"The Talbert Information Package" by Talbert Fuel Systems, Inc., dated Dec. 3, 1990.

"A Study of Factors Influencing the Evaporation Emissions From In–Use Automobiles," API Publication No. 4406, Apr., 1985, American Petroleum Institute.

"The Effect of Fuel Volatility Variations on Evaporative and Exhaust Emissions," API Publication 4310, May, 1979, Prepared for the American Petroleum Institute by Exxon Research and Engineering Company.

"Distillation Adjustment: An Innovative Step to Gasoline Reformulation" by Jeff A Gething, SAE Technical Paper 910382, 1991 SAE International Congress and Exposition, Detroit, Michigan, Feb. 25–Mar. 1, 1991.
"California Sets Tough Auto Standards" by Jananne Sharpless in *Fuel Reformulation* published Nov./Dec. 1991, pp. 8–10.
CRC Project No. CM–79–71, "Analysis of 1971 Road Rating Data: Unleaded Gasolines in 1971 Cars, Phase II: 1970–71 CRC Road Rating Program," Coordinating Research Council, Inc., Jun., 1973.
CRC Report No. 454, "Effect of Altitude Changes on Octane Number Requirement of Lat Model Cars," Oct., 1973.
CRC Report No. 455, "Evaluation of a High Temperature Driveability Test Procedure," Jun. 1973 pp. 1–3, 8–10, 39 & 40.
CRC Report No. 477, "1973 CRC Fuel Rating Program Part I: Road Octane Performance in 1973 Model Cars", Feb. 1975.
CRC Report No. 494, "1975 CRC Fuel Rating Program: Road Octane Performance in 1975 Model Cars", Oct. 1977.
CRC Report No. 510, "1978 Fuel Rating Program: Road Octane Performance in 1978 Model Cars", Aug. 1979, pp. 1–3, 17, & 18.
CRC Report No. 578, "Effect of Volatility and Oxygenates on Driveability at Intermediate Ambient Temperatures," Mar. 1992.
"Initial Findings of the 1989 CRC Cold–Start and Warm–Up Driveability Program," Yakima, Washington, CRC Project No. CM–118–89, Jun. 1990, with cover letter dated Jun. 13, 1990, by Beth Evans, Technical Project Coordinator to the Members of the CRC–Automotive Committee and the CRC–Volatility Group, Jun. 13, 1990.
SAE Paper No. 710138, "Passenger Car Driveability in Cool Weather," by J. D. Benson et al., 1971.
SAE Paper No. 720700, "Mathematical Expressions Relating Evaporative Emissions from Motor Vehicles Without Evaporative Loss–Control Devices to Gasoline Volatility," by W. F. Biller et al., 1972.
SAE Paper No. 720932, "The Effect of Gasoline Volatility on Exhaust Emissions," by P. J. Clarke, 1972.
SAE Paper No. 720933, "Driveability Testing on a Chassis Dynamometer," by R. J. Wahrenbrock et al., 1972.
SAE Paper No. 730474, "An Evaluation of the Performance and Emissions of a CRF Engine Equipped with a Prechamber," by D. B. Wimmer et al., 1973.
SAE Paper No. 730593, "Fuel Effects on Oxidation Catalysts and Catalyst–Equipped Vehicles," by A. H. Neal et al., 1973.
SAE Paper No.780611, "Fuel Volatility Effects on Driveability of Vehicles Equipped with Current and Advanced Fuel Management Systems," by C. R. Morgan et al., 1978.
SAE Paper No. 780651, "Hot Weather Volatility Requirements of European Passenger Cars," by R. F. Becker et al., 1978.
SAE Paper No. 780949, "The Effects of Refinery Gasoline Components on Road Octane Quality," by R. E. Burtner et al., International Fuels & Lubricants Meeting, Royal York, Toronto, Nov. 13–16, 1978.
SAE Paper No. 801352, "Evaluation of MTBE Gasoline by Japanese Passenger Cars," by Shintaro Miyawaki et al., 1980.
SAE Paper No. 841386, "Hot and Cold Fuel Volatility Indexes of French Cars: A Cooperative Study of the GFC Volatility Group," by Le Breton et al., 1984.
SAE Paper No. 902132, "Use of Ethyl–t–Butyl Ether (ETBE) as a Gasoline Blending Component," C. M. Shiblom et al., 1990.
NIPER—143–PPS–86/1, "Motor Gasolines, Summer 1985," by C. L. Dickson et al., Work performed by the American Petroleum Institute and the U.S. Department of Energy, National Institute for Petroleum and Energy Research, Bartlesville, Oklahoma, Jun. 1986.
"Petroleum Refinery Engineering," by W. L. Nelson, Fourth Edition, McGraw Hill Book Company, Inc., 1958, pp. 34 and 138.
"Future Automotive Fuels," by Ellis, Automotive Engineering, Jun. 1972, pp. 36–41.
CRC Report No. 445, "Influence of Leaded and Unleaded Fuels on Octane Requirement Increase in 1971 Model Cars," 20 Car Pilot Program at Southwest Research Institute, Mar. 1971, pp. 1 to 7, 17, 81–84, & 86.
CRC Report No. 451, "Influence of Leaded and Unleaded Fuels on Octane Requirement Increase in 1971 Model Cars, Phase 1: 1970–1971 CRC Road Rating Program," May 1972, Revised Sep. 1972, pp. 6, 7, 19, 96 to 98, 102, & 103.
CRC Report No. 467, "Octane Number Requirement Survey 1973," May 1974, pp. 1–4, 6,75, 76, 96, 97, & Table C–I.
CRC Report No. 476, "Octane Requirement Increase in 1973 Model Cars, Phase II: 1973 CRC Road Rating Program," Feb. 1975, pp.1–4, 45, 46, 48, & 49.
CRC Report No. 479, "Octane Number Requirement Survey 1974," Aug. 1975, pp. 1–4, 6, 67, 68, 69a, 85, & 85a.
CRC Report No. 488, "175 CRC Octane Number Requirement Survey," Aug. 1976.
CRC Report No. 493, "1976 CRC Octane Number Requirement Survey," Jul. 1977, pp. 1–4, 92, 93, 114, & 115.
CRC Report No. 497, "1977 CRC Octane Number Requirement Survey," Jun. 1978, pp. 1–5, 117, 118, & 143.
CRC Report No. 500, "1977 CRC Altitude Program," Feb. 1979, pp. 1–3, 76, & 77.
CRC Report No. 515, "1979 CRC Octane Number Requirement Survey," Apr. 1980, pp. 1–5, C2–C5, D5, and D6.
CRC Report No. 519, "1980 CRC Octane Number Requirement Survey," Jan. 1981, pp. 1–6, C3–C5, D5, and D6.
CRC Report No. 520, "1980 CRC Fuel Rating Program: Road Octane Performance in 1980 Model Cars," Jul. 1981, pp. 1–3, 17–19, B–6, & B–9.
CRC Report No. 523, "1981 CRC Altitude Octane Requirement Program," Dec. 1981, pp. 1–4, and D1–D4.
CRC Report No. 525, "1981 CRC Octane Number Requirement Survey," Aug. 1982, pp. 1–7, C1, C4, D2, D3, and D6.
CRC Report No. 533, "1982 CRC Octane Number Requirement Survey," Jul. 1983, pp. 1–7, C1, C4, D4, D5, and D8.
CRC Report No. 539, "1983 CRC Octane Number Requirement Survey," Aug. 1983, pp. i, 3, 7–11, 19, C1, C4, D4, D5, and D8.
CRC Report No. 541, "1982 CRC Fuel Rating Program: Road Octane Performance of Oxygenates in 1982 Model Cars," Jul. 1985, pp. 1–4, and 13–15.
CRC Report No. 544, "1984 CRC Octane Number Requirement Survey," Dec. 1985, the Abstract page, and pp. 3, 4, 7–11, 19, C1, C4, D7, and D10.
CRC Report No. 548, "1985 CRC Octane Number Requirement Survey," Oct. 1986, pp. i, 1–6, C1, C3, D5, & D8.
CRC Report No. 553, "1986 CRC Octane Number Requirement Survey," Aug. 1987, pp. i, 1–4, 6, C1, C3, D5, & D8.
CRC Report No. 561, "1987 CRC Octane Number Requirement Survey," Aug. 1988, pp. i, 1–7, C1, C3, & D8.

CRC Report No. 563, "1987 CRC Octane Number Requirement Rating Workshop," Sep. 1988, pp. i, 1–4, 7, & 8.
CRC Report No. 566, "1988 CRC Octane Number Requirement Survey," Aug. 1989, pp. i, 1–4, 6, 7, C1, C3, D3, D6, and D7.
CRC Report No. 567, "1989 CRC Octane Number Requirement Rating Workshop," Oct. 1989, pp. 1–7.
CRC Report No. 570, "1989 CRC Octane Number Requirement Survey," Aug. 1990, the Abstract page, and pp. 1–5, 7, 8, D3, D6, D7, Table C–1, and Table C–3.
CRC Report No. 575, "1990 CRC Octane Number Requirement Survey," Jul. 1991, pp. i, 1–3, 5, 6, C1, C3, D7, D10, and D11.
CRC Project No. CM–118–86/87,"CRC Low–and Intermediate–Temperature Driveability Program Using Gasoline Alcohol Blends,"Prepared by the Analysis Panel for the 1986/87 CRC Intermediate–and Low–Temperature Driveability Program, Jan. 1990, p. 22 (Table III), and B–7.
SAE Paper No. 710136, "The Effect of Gasoline Volatility on Emissions and Driveability," by P. J. Clarke, 1971.
SAE Paper No. 710364, "Effects of Fuel Factors on Emissions," by S. S. Sorem, 1971.
SAE Paper No. 710675, "Octane Requirement Increase in 1971 Model Cars with Leaded and Unleaded Gasolines," by H. A. Bigley, Jr. et al., 1971.
SAE Paper No. 720934, "New Emphasis on Fuel Volatility —Effects on Vehicle Warmup with Quick–Release Chokes," by R. F. Stebar et al, 1972.
SAE Paper No. 730616, "Gasolines for Low–Emission Vehicles", by J. C. Ellis, 1973.
SAE Paper No. 740520, "Cold Weather Driveability Performance of Late Model Cars," by A. M. Horowitz et al., 1974.
SAE Paper No. 740694, "Fuels and Emissions —Update and Outlook, 1974." by R. W. Hurn et al., 1974.
SAE Paper No. 750120, "Exhaust Emissions, Fuel Economy, and Driveability of Vehicles Fueled with Alcohol–Gasoline Blends," by N. D. Brinkman et al., 1975.
SAE Paper No. 750419, "Methanol–Gasoline Blends Performance in Laboratory Tests and in Vehicles," by A. W. Crowley et al., 1975.
SAE Paper No. 750451, "Establishment of ORI Characteristics as a Function of Selected Fuels and Engine Families," by H. T. Niles et al., 1975.
SAE Paper No. 750763, "Methanol/Gasoline Blends as Automotive Fuel," by J. R. Allsup, 1975.
SAE Paper No. 750937, "Octane Number Increase of Military Vehicles Operating on Unleaded Gasoline," by J. D. Tosh et al., 1975.
SAE Paper No. 770811, "Road Octane Number Trends of Japanese Passenger Cars," by K. Date et al, 1977.
SAE Paper No. 780612, "The Influence of Fuel Characteristics on Vaporization in the S.I. Engine Cylinder During Cranking at Low Temperature," by Y. Nakajima et al., 1978.
SAE Paper No. 780653, "The Hot–Fuel Handling Performance of European and Japanese Cars," by B. D. Caddock et al., 1978.
SAE Paper No. 790203, "The Effects of Fuel Composition and Fuel Additives on Intake System Detergency of Japanese Automobile Engine," by T. Nishizaki et al., 1979.
SAE Paper No. 790204, "A Novel Laboratory Method for Evaluating Induction System Deposits in Gasoline Engines," by H. W. Marbach et al., 1979.
SAE Paper No. 821211, "1980 CRC Fuel Rating Program —The Effects of Heavy Aromatics and Ethanol on Gasoline Road Octane Ratings," by M. J. Gorham et al., 1982.
SAE Paper No. 830937, "Gasoline Volatility and Hot Weather Driveability of Japanese Cars," by E. Yoshida et al., 1983.
SAE Paper No. 852132, "Gasoline Vapor Pressure Reduction—is an Option for Cleaner Air," by R. F. Stebar et al., 1985.
SAE Paper No. 872111, "An Engine Dynamometer Test for Evaluating Port Fuel Injector Plugging," by F. Caracciolo et al., 1987.
SAE Paper No. 892090, "Changes in Reid Vapor Pressure of Gasoline in Vehicle Tanks as the Gasoline is Used," by A. D. Brownlow et al., 1989.
SAE Paper No. 901114, "Volatility Characteristics of Blends of Gasoline with Ethyl Tertiary–Butyl Ether (ETBE)," by R. L. Furey, Government/Industry Meeting and Exposition Washington, D. C. May 1–4, 1990.
SAE Paper No. 902129, "The Seasonal Impact of Blending Oxygenated Organics with Gasoline on Motor Vehicle Tailpipe and Evaporative Emissions, Part II," by F. D. Stump et al., 1990.
BERC/RI–76/15, "Experimental Results Using Methanol and Methanol/Gasoline Blends as Automotive Engine Fuel," by J. R. Allsup, Published by Bartlesville Energy Research Center, Energy Research and Development Administration, Bartlesville, Oklahoma Jan. 1977, pp. 1–7.
HESD Report No. 35–32030, "Emissions and Vehicle Performance with Lower RVP Fuels," prepared for American Petroleum Institute by Automotive Testing Laboratories, Inc., Jan. 1988.
Report of Investigations 7291, "Influence of Volatile Fuel Components on Vehicle Emissions," by B.H. Eccleston et al., United States Department of the Interior, Bureau of Mines, 1970.
CRC Project No. CM–125–78, "Performance Evaluation of Alcohol–Gasoline Blends in 1980 Model Automobiles," Jul. 1982, p. C–13.
"NPC: U.S. Refiners Near Top Gasoline Capacity," *Oil & Gas Journal,* Oct. 13, 1986, p. 30.
Pp. 47–50 from the *Oil & Gas Journal,* Jun. 18, 1990.
"Released Reports," Jan. 1994, Coordinating Research Council, Inc., Atlanta, Ga.
"Reformulated Gasoline for Clean Air, an ARCO Assessment" by K. L. Boekhaus et al., for Roads to Alternative Transportation Fuels 2nd Biennial U.C. Davis Conference on Alternative Fuels Jul. 12, 1990.
"The Impact on Fuels of the 1990 Clean Air Act Amendments," by C. A. Lieder, presented at the NPR National Fuels and Lubricants Meeting, Nov. 1–2, 1990, Houston, Texas.
"Motor Fuels, Performance and Testing," William A. Gruse, Reinhold Publishing Corp., 1967, p. 104.
Publication No. 05–179263, Gasoline, Laid Open Jul. 20, 1993, Japanese Application No. 03–358562 filed Dec. 27, 1991.
Publication No. 03–263493, Lead–Free High–Octane Gasoline, Laid Open Nov. 22, 1991, Japanese Application No. 02–63537 filed Mar. 14, 1990.
Publication No. 03–229796, Fuel Oil Composition, Laid Open Oct. 11, 1991, Japanese Application No. 02–24005 filed Feb. 2, 1990.
Publication No. 01–234497, Lead–Free High Octane Value Gasoline, Laid Open Sep. 19, 1989, Japanese Application No. 63–59587 filed Mar. 14, 1988.

Publication No. 01–131299, Fuel Composition for Use in Gasoline Engine, Laid Open May 24, 1989, Japanese Application No. 63–247245 filed Sep. 29, 1988.
Publication No. 01–9293, Clear Gasoline, Laid Open Jan. 12, 1989, Japanese Application No. 62–162966 filed Jun. 30, 1987.
Publication No. 63–317593, Unleaded Regular Gasoline, Laid Open Dec. 26, 1988, Japanese Application No. 62–154189 filed Jun. 20, 1987.
Publication No. 63–317592, Production of High–Powered Fuel Oil, Laid Open Dec. 26, 1988, Japanese Application No. 62–153837 filed Jun. 19, 1987.
Publication No. 63–317591, High–Powered Fuel Oil, Laid Open Dec. 24, 1988, Japanese Application No. 62–153836 filed Jun. 19, 1987.
Publication No. 63–317590, Unleaded and High–Octane Gasoline, Laid Open Dec. 26, 1988, Japanese Application No. 62–153026 filed Jun. 19, 1987.
Publication No. 63–289094, Lead–Free, High Octane Gasoline, Laid Open Nov. 25, 1988, Japanese Application No. 62–123129 filed May 20, 1987.
Publication No. 61–176694, Gasoline Composition, Laid Open Aug. 8, 1986, Application No. 60–17120 filed Jan. 31, 1985.
Publication No. 61–166884, Fuel Composition for Gasoline Engine, Laid Open Jul. 28, 1986, Japanese Application No. 61–14308 filed Jan. 24, 1986.
Publication No. 61–16985, Manufacture of Unleaded Gasoline of High Octane Value, Laid Open Jan. 24, 1986, Japanese Application No. 59–137525 filed Jul. 3, 1984.
Publication No. 61–16984, Manufacture of Gasoline Mainly from Hydrocarbon of Boiling Point Lower Than 220° C. Such as Petroleum Naphtha or Naphtha–Cracked Gasoline, Laid Open Jan. 24, 1986, Japanese Application No. 59–138668 filed Jul. 4, 1984.
Publication No. 60–130684, Fuel Composition, Laid Open Jul. 12, 1985, Japanese Application No. 58–237881 filed Dec. 19, 1983.
*Fuel and Energy Abstracts,* May 1990, Oil Gas J., May 1989, 87 (20), 35–40.
*Fuel and Energy Abstracts,* May 1990, Pure Appl. Chem., 1989, 61, (8), 1373–1378.
*Fuel and Energy Abstracts,* Mar. 1990, Oil Gas J., Apr. 1989, 87, (16) 44–48.
*Fuel and Energy Abstracts,* Sep., 1989, *Chem. Aust.,* 1989, 56, (3), 77–79.
*Fuel and Energy Abstracts,* Sep., 1989, Erdoel, Erdgas, Kohle, 1988, 104, (9), 368–371. (In German).
*Fuel and Energy Abstracts,* Mar., 1989, *Erdoel Kohle, Erdas, Petrochem.,* Dec. 1988, 41, (12), 491, 496.
"Proposed Regulations for Low–Emission Vehicles and Clean Fuels", Staff Report, State of California Air Resources Board, Aug. 13, 1990.
"Initial Mass Exhaust Emissions Results from Reformulated Gasolines," Auto/Oil Air Quality Improvement Research Program, Dec. 1990.
"Development of Ozone Reactivity Scales for Volatile Organic Compounds," William P. L.Carter, Statewide Air Pollution Research Center, EPA Contract CR–814396–01–0, Apr., 1990, University of California, Riverside, CA 92521.
Information Disclosure Statement No. 2 from U.S. patent Application Ser. No. 08/077,243 filed Jun. 14, 1993.
Information Disclosure Statement No. 3, Sections D through G, from U.S. patent application Ser. No. 08/077,243, filed Jun. 14, 1993.
Information Disclosure Statement No. 5 from U.S. patent application Ser. No. 08/077,243 filed Jun. 14, 1993.
Letter from Coordinating Research Council signed by Beth Evans, dated May 19, 1989, addressed to Unocal Corporation (four pages).
Letter from Coordinating Research Council signed by Beth Evans, dated Nov. 21, 1988 addressed to Members of the CRC Automotive Committee with an attachment entitled "1989 CRC Program on the Effect of Volatility on Driveability at Intermediate Ambient Temperatures" (Nov. 1988).
Letter from Alan Zengel to the Members of the CRC Volatility Group, dated Dec. 20, 1988, with attachment letter from Joseph Colucci to Alan Zengel dated Dec. 12, 1988.
One page memo from E. H. Schanerberger of Ford Motor to Beth Evans of CRC, dated Jan. 11, 1989.
Cover Letter from Beth Evans to the Members of the CRC Volatility Group dated Feb. 7, 1989, with a four page letter attachment from Scott Jorgensen to Alan Zergel.
Two page letter from A.M. Horowitz to Shirley Bradicich dated Mar. 7, 1989 and entitled "Automotive Vehicle Fuel, Lubricant and Equipment Committee".
Internal, three page Unocal corporate memorandum by Tim Wusz to Gerald Wessler dated Mar. 28, 1988 (apparently misdated, sic Mar. 28, 1989).
Letter from R. M. Reuter of Texaco, Inc., dated Mar. 29, 1990 addressed to Participants in the 1989 CRC Driveability Program —Yakima.
"Unconfirmed Minutes of the Meeting of the Volatility Group of the Automotive Vehicle Fuel, Lubricant, and Equipment Research Committee" for CRC Project No. CM–118–90, dated Oct. 23, 1990.
"Unconfirmed Minutes of the Meeting of the Volatility Group of the Automotive Vehicle Fuel, Lubricant, and Equipment Research Committee" for CRC Project No. CM–118–91, dated Oct. 9, 1991.
"Effect of Volatility on Driveability at Intermediate Ambient Temperatures", (CRC Project No. CM–118–89) (Not to be published), prepared by the CRC Volatility Group of Coordinating Research Council, dated Jan. 1992.
SAE 780588, "The Inter–Industry Emission Control Program —Eleven Years of Progress in Automotive Emissions and Fuel Economy Research," McCabe et al., pp. 1–7 (entire document).
SAE 710295, "Effect of Fuel and Lubricant Additives on Exhaust Emissions," Mixon et al., Inter–Industry Emission Control, SP–361, Jan. 11–15, 1971, coveorsheet, pp. 1207–1220.
"Aviaton Fuels, 1969," *Mineral Industry Surveys,* Petroleum Products Survey No. 64, McKinney et al., Mar. 1970, title page, table of contents and pp. 5–6.
"Aviation Fuels, 1964," *Mineral Industry Surveys,* Petroleum Products Survey No. 39, O. C. Blade, May 1965, title page, table of contents and p. 12.
"Aviation Fuels, 1983," (Niper 134) National Institute for Petroleum and Energy Research, Shelton et al., Bartlesville, OK, Apr. 1984, cover page, title page and pp. 5–7.
All Cities SWRI Competitive Fuel Survey —Gasoline, Jul. 1985, p. 3.
MVMA National Fuel Survey, Summer Season, Oct. 15, 1976.
"Motor Gasolines, Summer 1971," *Mineral Industry Surveys,* Petroleum Products Survey No. 73, E. M. Shelton, Jan. 1972, cover page, table of contents and pp. 45, 47, 53 and 55–56.

"Motor Gasolines, Winter 1970–1971," *Mineral Industry Surveys,* Petroleum Products Survey No. 70, Shelton et al., Jun. 1971, cover page, table of contents and p. 44.
"Motor Gasolines, Summer 1972," *Mineral Industry Surveys,* Petroleum Products Survey No. 78, E. M. Shelton, Jan. 1973, cover page, table of contents and pp. 46–48.
CRC 434, "Octane Number Requirement Survey," Sep. 1970, cover page, title page and pp. 4–5 and 75–78.
CRC 464, "Octane Number Requirement Survey 1972," Sep. 1973, cover page, title page and p. 6 and 86–92.
CRC 486, "Driveability Performance of 1975 Passenger Cars at Intermediate Ambient Temperatures —Paso Robles," May 1976, cover page, title page and pp. 5–6 and 20–21.
"A New Approach to Blending Octanes," Proceedings American Petroleum Institute, Section III–Refining, New York, NY, vol. 39, Healy, Jr., et al. (1959), pp. 132–192.
"Test Gasoline Matrix" a two–page document with handwritten date of Jul. 17, 1990.
"Effect of Gasoline Property on Exhaust Emissions and Driveability," Toyota Motor Corporation, dated oct. 1990, 19 pages.
SAE 902094, "Effects of Gasoline Composition on Exhaust Emissions and Driveability," Hoshi et al., dated Oct. 22–25, 1990.

Analysis of Howell Midstates Unleaded Racing Fuel Jul. 1988.

"Carburetor Evaporation Losses" by Wentworth, SAE Paper No. 12B presented Jan. 1958 at the SAE Annual Meeting (pp. 146–156) in *Vehicle Emissions,* Society of Automotive Engineers, Technical Progress, Series, vol. 6, 1964.

Progress Report to RPC, Data Analysis and Report Writing Subcommittee, A. H. Hochhauser. Jul. 26, 1990 (8 pages).

Information Disclosure Statement No. 7 of parent application Ser. No. 08/409,074, filed Mar. 22, 1995.

Information Disclosure Statement No. 8 of parent application Ser. No. 08/409,074, filed Mar. 22, 1995.

Information Disclosure Statement No. 10 of parent application Ser. No. 08/409,074, filed Mar. 22, 1995.

"Effect of Automotive Emission Requirements on Gasoline Characteristics," ASTM STP 487, pp. 1–31, 1970.

Emissions Test Data - CO

Emissions Test Data - NOx

+ + + 1989 Calais □ □ □ 1988 Olds 98

○ ○ ○ 1990 Lincoln • • • 1989 Taurus

⊕ ⊕ ⊕ 1990 Shadow ◇ ◇ ◇ 1990 Camry

Emissions Test Data - HC

Emissions Test Data - CO

Emissions Test Data - NOx

Emissions Test Data - HC

*Figure 7*
*Individual Car Effects - CO*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | | - | | | | | + + + | | | 0.974 |
| 198 Oldsmobile 98 | | | - | | | | | + | | | 0.974 |
| 1985 Tempo | | | - | | | | | + + | | | 0.972 |
| 1990 Lincoln | | | | | | | | + | | | 0.971 |
| 1984 Caprice | - | | | | | | | + | | | 0.926 |
| 1988 Accord | | | | | | | | + | | | 0.944 |
| 1989 Taurus | | | | | | | | + | | | 0.980 |
| 1990 Shadow | | | – | | | | | + | + | | 0.966 |
| 1985 Suburban | | | + | | | | | + + | (-) | | 0.962 |
| 1990 Camry | | | - | | | | | + + | | | 0.968 |

Note: () indicates minor effects

*Figure 8*
*Individual Car Effects - NOx*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | + | (-) | | | | (+) | | | + + + | 0.973 |
| 1988 Oldsmobile 98 | | + | | | | | (+) | | | + + + | 0.965 |
| 1985 Tempo | | + | | | | | (+) | | | + + + + | 0.992 |
| 1990 Lincoln | | + | | | | | + | | | + + + + + + + + + + | 0.995 |
| 1984 Caprice | | + | | | | | + | | | + + + + | 0.994 |
| 1988 Accord | | + | (-) | | | | (+) | | | + + + + + + + + + + | 0.978 |
| 1989 Taurus | | + | | | | | (+) | | | + + + + + | 0.991 |
| 1990 Shadow | | + | | | | | (+) | | | + + + + + + + + | 0.995 |
| 1985 Suburban | | + | | | | | + | | | + + + + + | 0.990 |
| 1990 Camry | | + | | | | | (+) | | | | 0.894 |

Note: () indicates minor effects

*Figure 9*
*Individual Car Effects - HC*

| Car | Fuel Variable | | | | | | | | | | $R^2$ |
|---|---|---|---|---|---|---|---|---|---|---|---|
| | Arom | Olef | Para | MTBE | RON | MON | T10 | T50 | T90 | RVP | |
| 1989 Calais | | + + | | | – | | | + | | | 0.967 |
| 1988 Oldsmobile 98 | | | | | - | | | + | | | 0.948 |
| 1985 Tempo | – | | | | | | | + | | | 0.993 |
| 1990 Lincoln | - | | | | | | | + | | | 0.961 |
| 1984 Caprice | – | | | | | | | + | | | 0.952 |
| 1988 Accord | – | | | | | | | + | | | 0.951 |
| 1989 Taurus | | + | | | - | | | + | | | 0.973 |
| 1990 Shadow | - | | | | | | | + | | | 0.965 |
| 1985 Suburban | - | | | | | | | + | | | 0.988 |
| 1990 Camry | | + + | | | - | | | + | | | 0.977 |

GASOLINE FUEL

CROSS-REFERENCES TO RELATED APPLICATIONS

This application is a continuation of U.S. patent application Ser. No. 08/409,074, filed in the United States Patent and Trademark Office on Mar. 22, 1995, now U.S. Pat. No. 5,593,567 which application is a continuation of U.S. patent application Ser. No. 08/077,243, filed in the U.S. Patent and Trademark Office on Jun. 14, 1993, now abandoned, which application is a division of U.S. patent application Ser. No. 07/628,488, filed in the U.S. Patent and Trademark Office on Dec. 13, 1990, now U.S. Pat. No. 5,288,393.

The present invention relates to fuels, particularly gasoline fuels, and combustion methods therefor, and methods for preparing gasoline fuels which, upon combustion, minimize the release of CO, NOx, and/or hydrocarbon emissions to the atmosphere.

One of the major environmental problems confronting the United States and other countries is atmospheric pollution (i.e., "smog") caused by the emission of gaseous pollutants in the exhaust gases from automobiles. This problem is especially acute in major metropolitan areas, such as Los Angeles, Calif., where the atmospheric conditions and the great number of automobiles account for aggravated air pollution.

It is well known that the three primary gaseous constituents, or pollutants, which contribute to air pollution due to auto exhaust are nitrogen oxides (NOx), carbon monoxide (CO), and unburned or incompletely burned hydrocarbons (i.e., hydrocarbon components originally present in the gasoline fuel which are not fully converted to carbon monoxide or dioxide and water during combustion in the automobile engine).

SUMMARY OF THE INVENTION

The present invention provides gasoline fuels from which a relatively low amount of gaseous pollutants, and in particular one or more of NOx, CO, and hydrocarbons, is produced during combustion in an automotive engine. The invention provides methods for producing gasoline fuels having such desirable properties. The invention also provides methods of combusting such fuels in automotive engines while minimizing emission of pollutants released to the atmosphere, which in turn provides a method for reducing air pollution, particularly in congested cities and the like, when large volumes of automotive fuel of the invention are combusted in a great number of automobiles in a relatively small geographical area.

The present invention also provides a petroleum refiner with knowledge of which properties of a gasoline fuel to alter, and in which direction (i.e., increased or decreased), so as to produce a gasoline fuel which will reduce or minimize NOx, CO, and hydrocarbon emissions upon combustion in an automotive engine.

The present invention, in its broadest aspect, is founded on the discovery that, when gasoline fuels are produced, for example, by blending a plurality of hydrocarbon-containing streams together so as to produce a gasoline product suitable for combustion in an automotive spark-induced internal combustion engine, improvements in emissions of one or more pollutants selected from the group consisting of CO, NOx, and hydrocarbons upon combustion of the gasoline product in such an engine system can be attained by controlling certain chemical and/or physical properties of said gasoline product. For example, a first hydrocarbon-containing stream boiling in the gasoline range can be blended with a different hydrocarbon stream at rates adjusted so as to effect at least one of the properties of the first gasoline stream as follows:

(1) decrease the 50% D-86 Distillation Point;
(2) decrease the olefin content;
(3) increase the paraffin content;
(4) decrease the Reid Vapor pressure;
(5) increase the Research Octane Number;
(6) decrease the 10% D-86 Distillation Point;
(7) decrease the 90% D-86 Distillation Point; and
(8) increase the aromatic content The greater the increase or decrease of the eight properties as set forth above, the greater the resulting benefit in reducing emissions of one or more of CO, NOx, and hydrocarbons.

For gasoline fuels in which one desires that hydrocarbon emissions and/or CO emissions be minimized or reduced, the principal factor influencing such emissions is the 50% D-86 distillation point, with decreases therein causing decreases in the hydrocarbon emissions. Fuels generally prepared in accordance with this embodiment of the invention have a 50% D-86 distillation point no greater than 215° F. (101.6° C.), with the hydrocarbon and CO emissions progressively decreasing as the 50% D-86 distillation point is reduced below 215° F. (101.6° C.). Preferred fuels have a 50% D-86 Distillation Point of 205° F. (96.1° C.) or less. Best results are attained with fuels having a 50% D-86 distillation point below 195° F. (90.6° C.).

For gasoline fuels in which one desires that emissions of NOx be minimized or reduced, the principal factor influencing such emissions is Reid Vapor pressure. NOx emissions decrease as the Reid Vapor Pressure is decreased (e.g., to 8.0 psi (0.54 atm) or less, preferably to 7.5 psi (0.51 atm) or less, and even more preferably below 7.0 psi (0.48 atm)). Of secondary importance with respect to NOx emissions are the 10% D-86 Distillation Point and the olefin content. In general, decreasing olefin content (e.g., below 15 volume percent, preferably to essentially zero volume percent) and/or decreasing the 10% D-86 Distillation Point (e.g., to values below 140° F. (60° C.)) will provide some reduction in NOx emissions. However, because it is contemplated that decreases in olefin content will be more acceptable to an oil refiner than decreasing the 10% D-86 Distillation Point sufficiently to significantly affect the NOx emissions, it is believed that, as a practical matter, it will be olefin content which will be the secondary variable providing the most flexibility to an oil refiner in altering the gasoline properties to reduce NOx emissions. (This is all the more the case inasmuch as, in general, if one wishes to decrease the Reid Vapor Pressure, it is usually necessary to increase the 10% Distillation Point.) Accordingly, best results are attained when both the olefin content is below 15 volume percent (preferably to zero) and the Reid vapor pressure is no greater than 7.5 psi—with it being highly desirable, if possible, to also maintain the 10% D-86 Distillation Point below 140° F. (60° C.).

In view of the foregoing, it can be seen that many modifications of the invention are possible, depending upon which of the three pollutants one desires to reduce and the degree of reduction desired. For example, one can attain significant reductions in all three pollutants—hydrocarbons, CO, and NOx—by maintaining the 50% D-86 distillation point at or below about 215° F. (101.6° C.) and maintaining the Reid Vapor Pressure no greater than 8.0 psi (0.54 atm).

Still better reductions can be obtained by maintaining the olefin content below 10 volume percent, or maintaining the 10% D-86 distillation point below 140° F. (60° C.), with still further reductions being possible when both the olefin content and 10% D-86 Distillation Point are so maintained. Yet further reductions are possible by maintaining the 50% D-86 distillation point below 195° F. (90.6° C.), by reducing the olefin content to below 5.0 vol.% (preferably to essentially zero), by decreasing the 10% D-86 Distillation Point to below 120° F. (49° C.), and/or by maintaining the Reid Vapor pressure below 7.0 psi (0.48 atm).

The presently preferred specifications proposed for commercial use for a gasoline produced in accordance with the invention are: (1) Olefin Content of 0%; (2) Reid Vapor Pressure of 7.5 psi (0.51 atm) maximum; and (3) 50% D-86 distillation point greater than 180° F. (82° C.) but no greater than 205° F. (96° C.). However, other fuels falling within the scope of the invention are also possible, for example, fuels meeting the following criteria:

(1) a 50% D-86 distillation point no greater than 215° F. (101.7° C.) and a Reid Vapor Pressure no greater than 8.0 psi (0.54 atm).

(2) a 50% D-86 distillation point no greater than 205° F. (96° C.) and an olefin content less than 3 percent by volume;

(3) a Reid Vapor Pressure no greater than 8.0 psi (0.54 atm) and containing at least 40 volume percent paraffins;

(4) a Reid Vapor Pressure no greater than 7.5 psi (0.51 atm) and containing essentially no methyl tertiary butyl ether but less than 15 volume percent olefins.

One of the main advantages of the invention is that a less polluting gasoline fuel is provided that can be easily prepared in a petroleum refinery or the like. That is, in a typical refinery in which gasoline is produced, it is necessary or at least desirable in most instances to blend the hydrocarbon stocks so as to produce gasolines of specified Reid Vapor Pressure, olefins content, etc. Thus, the only difference is that now the refinery will blend the stocks in light of the information provided herein such that the NOx, CO, and hydrocarbon emissions are reduced as much as possible or practicable, given the individual situation (the blend stocks available, refining capacity, etc.) facing the particular refinery.

It will be understood in this disclosure and the claims to follow that the words "reduce" and "reducing" in the context of lowering NOx, CO, or hydrocarbon emissions are relative terms. Obviously, the simplest way to produce no emissions is to combust no fuel; and equally obviously, almost any combustion of a gasoline fuel will produce some emissions and thus produce greater emissions than if no fuel were combusted. However, on the assumption that the motoring public would find the consequences of combusting no fuel rather unattractive, logic dictates in the context of this invention that "reducing" is in comparison to the results achievable with other fuels. For example, for those embodiments of the invention in which the 50% D-86 Distillation Point is controlled to no more than 200° F. (93° C.), the emissions will be reduced in comparison to the otherwise identical fuel but having a higher 50% D-86 Distillation Point when combusted in the same automotive engine (or in an equivalent number of automotive engines) operating for the same time period in the same way.

BRIEF DESCRIPTION OF THE DRAWING

The invention can be best understood with reference to the drawing, the figures of which provide graphical or tabular data derived from the experiments described hereinafter with respect to Examples 2 and 3.

More particularly.

FIG. 7 is a table, based on data derived from the experiments in Examples 2 and 3, which identifies the most significant variables which increase emissions of CO when the variable is increased (as identified by one or more + signs) or which decrease emissions of CO when the variable is decreased (as identified by one or more – signs).

FIG. 8 is a table, based on data derived from the experiments in Examples 2 and 3, which identifies the most significant variables which increase emissions of NOx when the variable is increased (as identified by one or more + signs) or which decrease emissions of NOx when the variable is decreased (as identified by one or more – signs).

FIG. 9 is a table, based on data derived from the experiments in Examples 2 and 3, which identifies the most significant variables which increase emissions of hydrocarbons when the variable is increased (as identified by one or more + signs) or which decrease emissions of hydrocarbons when the variable is decreased (as identified by one or more – signs).

DETAILED DESCRIPTION OF THE INVENTION

Figure 1:
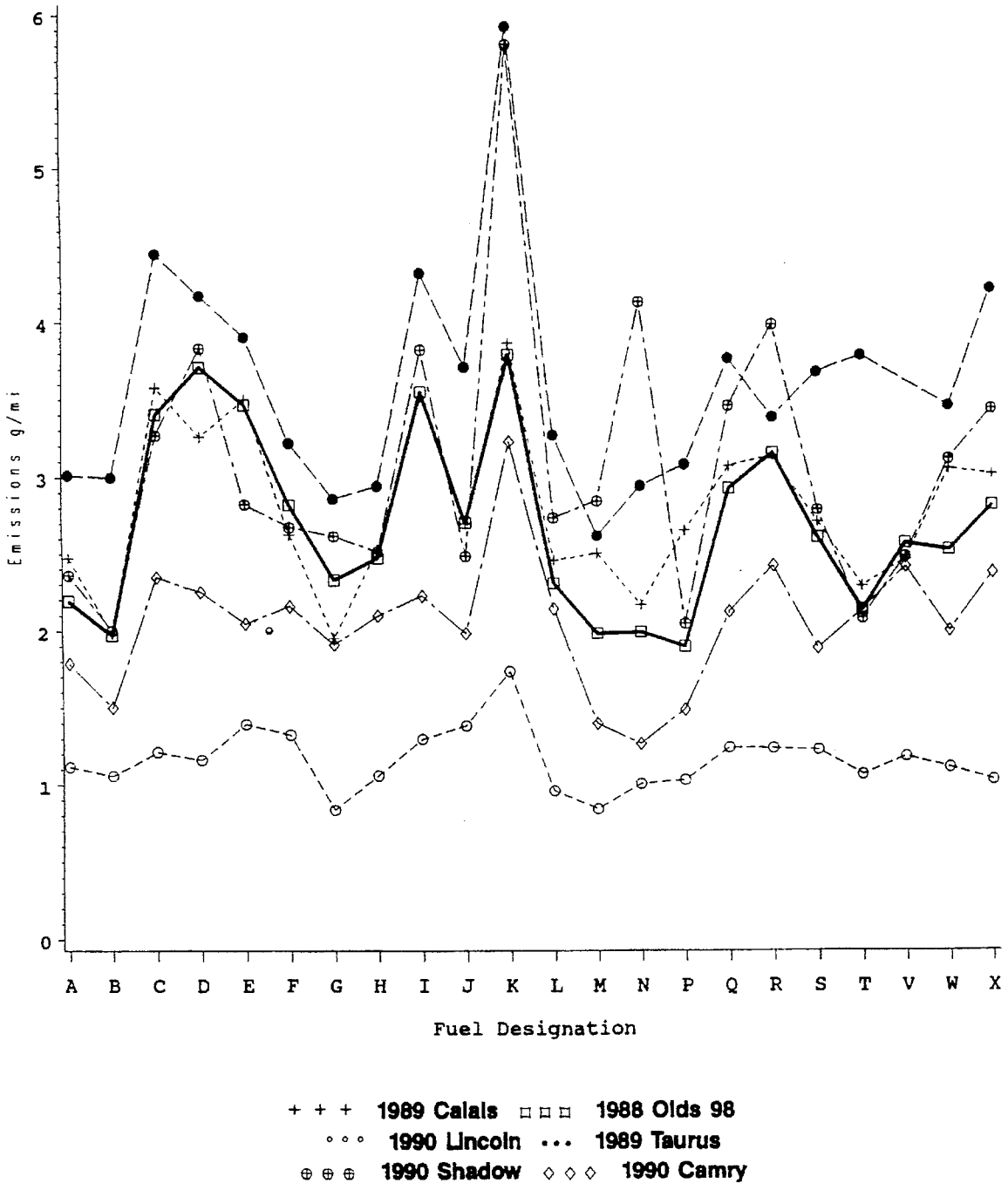
FIG. 1 is a graph of CO emission values for 22 different fuels tested in six different automobiles. Each data point on the graph is an average of a plurality of runs for each fuel-automobile combination.

The present invention is directed to gasoline compositions having chemical and physical properties which reduce and/or minimize the amount of gaseous pollutants emitted during combustion. In particular, the invention aims to reduce and/or minimize the emissions of hydrocarbons, NOx and/or CO during combustion in an automotive engine.

Gasolines are well known fuels, generally composed of a mixture of hydrocarbons boiling at atmospheric pressure in a very narrow temperature range, e.g., 77° F. (25° C.) to 437° F. (225° C.). Gasolines are typically composed of mixtures of aromatics, olefins, and paraffins, although some gasolines may also contain such added non-hydrocarbons as alcohol (e.g., ethanol) or oxygenates (e.g., methyl tertiary butyl ether). Gasolines may also contain various additives, such as detergents, anti-icing agents, demulsifiers, corrosion inhibitors, dyes, deposit modifiers, as well as octane enhancers such as tetraethyl lead. However, the preferred fuels contemplated in the invention are unleaded gasolines (herein defined as containing a concentration of lead no greater than 0.05 gram of lead per gallon (0.013 gram of lead per liter)). The preferred fuels will also have a Research Octane Number (RON) of at least 90. Octane value (R/2+M/2) for regular gasoline is generally at least 87 and for premium at least 92.

At present, most gasolines suitable for combustion in automotive spark-ignition engines conform to the requirements of ASTM D4814-89 specifications, which specifications are herein incorporated by reference in their entirety. Such gasolines fall into five different volatility classes, with some of the specifications therefor set forth in the following Table 1:

TABLE 1

| Properties | Class A | Class B | Class C | Class D | Class E |
|---|---|---|---|---|---|
| RVP | | | | | |
| (psi) max | 9.0 | 10.0 | 11.5 | 13.5 | 15.0 |
| (atm) max | 0.6 | 0.7 | 0.8 | 0.9 | 1.0 |
| Dist. 10% | | | | | |
| (°F.) max | 158 | 149 | 140 | 131 | 122 |
| (°C.) max | 70 | 65 | 60 | 55 | 50 |
| Dist. 50% | | | | | |
| (°F.) min–max | 170–250 | 170–245 | 170–240 | 170–235 | 170–230 |
| (°C.) min–max | 77–121 | 77–118 | 77–116 | 77–113 | 77–110 |
| Dist. 90% | | | | | |
| (°F.) max | 374 | 374 | 365 | 365 | 365 |
| (°C.) max | 190 | 190 | 185 | 185 | 185 |
| End Point | | | | | |
| (°F.) max | 437 | 437 | 437 | 437 | 437 |
| (°C.) max | 225 | 225 | 225 | 225 | 225 |

The most preferred gasolines produced in accordance with the invention are those which meet the requirements of one or more of the five classes specified in Table 1.

In the present invention, the gasoline is formulated, usually by appropriately blending various hydrocarbon streams in a refinery, to reduce or minimize emissions of CO, NOx, and/or hydrocarbons upon combustion in a spark-induced automotive internal combustion engine. It has been discovered in the present invention, for many automotive engines, that the amount of pollutants emitted upon combustion is closely in accord with the following equations:

Equation 1

$$\text{CO (gm per mile)} = K_1 \times (\text{D-86 Dist. 50\% Point in °F.}) + K_2 \times (\text{D-86 Dist. 90\% Point in °F.}) - K_3 \times (\text{Vol. \% Paraffins})$$

Equation 2

$$\text{NOx (gm per mile)} = K_4 \times (\text{Vol. \% Olefins}) - K_5 \times (\text{Vol. \% Paraffins}) + K_6 \times (\text{D-86 Dist. 10\% Point in °F.}) + K_7 \times (\text{RVP in psi})$$

Equation 3

$$\text{HC (gm per mile)} = K_8 \times (\text{Vol. \% Olefins}) - K_9 \times (\text{Research Octane Number}) + K_{10} \times (\text{D-86 Dist. 50\% Point in °F.})$$

where each K value in the foregoing equations is a positive number. The K values will be fixed for a particular engine in a particular car but can be readily determined. For example, for a 1988 Oldsmobile Regency 98 equipped with a 3.8 liter V-6 Engine, the K values are such that the equations are as follows:

Equation 4

$$\text{CO (gm per mile)} = 0.00937 \times (\text{D-86 Dist. 50\% Point in °F.}) + 0.00133 \times (\text{D-86 Dist. 90\% Point in °F.}) - 0.00828 \times (\text{Vol. \% Paraffins})$$

Equation 5

$$\text{NOx (gn per mile)} = 0.00503 \times (\text{Vol. \% Olefins}) - 0.0060 \times (\text{Vol. \% Paraffins}) + 0.0087 \times (\text{D-86 Dist. 10\% Point in °F.}) + 0.0159 \times (\text{RVP in psi})$$

Equation 6

$$\text{HC (gm per mile)} = 0.00245 \times (\text{Vol. \% Olefins} - 0.00104 \times (\text{Research Octane Number}) + 0.00109 \times (\text{D-86 Dist. 50\% Point in °F.})$$

From the foregoing equations, and from the relative sizes of the various K values and the typical values which would pertain for the properties by which the K values are multiplied (e.g., Vol. % Olefins, Research Octane Number, etc.), the following conclusions are obtained for the 1988 Oldsmobile Regency 98 and similar automobiles: For CO emissions, although decreasing the 90% D-86 distillation point has some impact on lowering CO emissions, the paraffin content and the 50% D-86 Distillation point influence such emissions much more substantially. All other things being equal, increasing the paraffin content or reducing the 50% D-86 distillation point will provide the most dramatic effects in reducing CO emissions, with best results being attained when both the paraffin content is substantially increased and the 50% D-86 distillation point is substantially reduced. In like manner, it can be seen that by decreasing the 10% D-86 Distillation Point and/or by increasing the paraffin content, some decrease in the NOx emissions will be produced. However, far more influential on the NOx emissions are the olefin content and the Reid Vapor Pressure, both of which cause substantial reductions in NOx emissions as they are substantially decreased. For hydrocarbon emissions, inspection of the equations indicates, since one is usually constrained to no more than a 5 unit change in Research Octane Number in the range of about 90 to 95, that it will not normally be practicable to alter the Research Octane Number sufficiently to have a significant impact on the hydrocarbon emissions. Accordingly, although some reduction in hydrocarbon emissions can be attained by increasing the Research Octane Number, the most practical way to significantly lower the hydrocarbon emissions while retaining other beneficial properties of the fuel is by lowering the olefin content and/or by lowering the 50% D-86 Distillation Point.

The foregoing equations also provide those skilled in the art, again as to a 1988 Oldsmobile Regency 98 and similar automobiles, with information as to how to lower the reductions of not just CO, NOx, or hydrocarbons, but also any combination thereof. For example, if one is interested in reducing the emission levels of all three, the equations show, if all other properties are held essentially constant, that reducing the Reid Vapor Pressure and the 50% D-86 distillation point will decrease the emissions of CO, NOx, and hydrocarbons. Likewise, decreases in these three pollutants can be attained by decreasing the 50% D-86 Distillation Point and decreasing the olefin content.

The above equations also lead to the following conclusions (again as to the 1988 Oldsmobile Regency and similar automobiles):

All other properties of a gasoline fuel being substantially the same,

1. As the 50% D-86 Distillation Point is progressively decreased, progressively greater reductions in CO and hydrocarbons emissions will result;
2. As the olefin content is progressively decreased, progressively greater reductions in NOx and hydrocarbons emissions will result;
3. As the paraffin content is progressively increased, progressively greater reductions in CO and NOx emissions will result;
4. As the Reid Vapor pressure is progressively decreased, progressively greater reductions in NOx emissions will result;
5. As the Research Octane Number is progressively increased, progressively greater reductions in hydrocarbon emissions will result;
6. As the 10% D-86 Distillation Point is progressively decreased, progressively greater reductions in NOx emissions will result;
7. As the 90% D-86 Distillation Point is progressively decreased, progressively greater reductions in CO emissions will result.

And, of course, combining any of the above seven factors will lead to yet progressively greater reductions. However, as will become evident in light of the data in the examples to follow, the most important of the foregoing factors are Reid Vapor Pressure (for reducing NOx) and the 50% D-86 Distillation Point (for reducing CO and hydrocarbon emissions). Of secondary importance in reducing NOx are the olefin content and the 10% D-86 Distillation Point, with the former being of greater influence than the latter. The following Examples serve to further illustrate the inventive concept and are not intended to be construed as limitations on the invention, which is defined by the claims.

EXAMPLE 1

A total of 22 different unleaded gasoline fuels was tested in a 1988 Oldsmobile Regency 98 automobile equipped with a 3800 cc V-6 engine. This automobile was selected because it represented a high sales volume product with close to the current state-of-the-art emission technology. The emission system was closed loop control on the air to fuel ratio with a three way catalyst system and adaptive learning capability. The automobile had been previously driven for 38,000 miles to stabilize the Octane Requirement Increase.

The properties of each of the 22 fuels are shown in the following Table 2.

TABLE 2

GASOLINE PROPERTIES

| Blend Designation | Aromatic Vol. % by FIA | Olefins Vol. % by FIA | Paraffins Vol. % by FIA | MTBE Vol. % by IR | Research Octane Number | Motor Octane Number | D86 Dist. 10% point (°F.) | D86 Dist. 50% point (°F.) | D86 Sist. 90% point (°F.) | Reid Vapor Pressure psi |
|---|---|---|---|---|---|---|---|---|---|---|
| AR3951-1 | 7.60 | 0.2 | 92.20 | 0.0 | 93.6 | 89.2 | 131 | 209 | 299 | 9.00 |
| AR3951-2 | 6.60 | 0.0 | 93.40 | 0.0 | 90.3 | 86.8 | 111 | 203 | 383 | 10.10 |
| AR3951-3 | 43.30 | 9.5 | 47.20 | 0.0 | 96.1 | 84.5 | 126 | 235 | 312 | 8.90 |
| AR3951-4 | 47.50 | 8.3 | 44.20 | 0.0 | 95.8 | 84.4 | 150 | 251 | 355 | 5.60 |
| AR3951-5 | 38.15 | 0.2 | 61.65 | 0.0 | 91.3 | 82.7 | 166 | 221 | 284 | 6.37 |
| AR3951-6 | 11.90 | 15.9 | 55.00 | 17.2 | 91.5 | 82.2 | 128 | 174 | 368 | 8.50 |
| AR3951-7 | 36.80 | 0.6 | 48.30 | 14.3 | 95.0 | 86.1 | 120 | 224 | 405 | 9.70 |
| AR3951-8 | 12.30 | 12.7 | 60.40 | 14.6 | 94.4 | 85.1 | 120 | 185 | 341 | 9.20 |
| AR3951-9 | 44.10 | 11.3 | 44.60 | 0.0 | 96.6 | 84.5 | 128 | 229 | 305 | 8.80 |
| AR3951-10 | 4.50 | 19.6 | 75.90 | 0.0 | 94.4 | 84.8 | 127 | 195 | 310 | 9.70 |
| AR3951-11 | 51.60 | 11.6 | 36.80 | 0.0 | 95.9 | 84.0 | 149 | 308 | 382 | 6.50 |
| AR3951-12 | 28.80 | 0.6 | 55.70 | 14.9 | 92.9 | 85.7 | 128 | 210 | 271 | 9.55 |
| AR3951-13 | 14.70 | 17.9 | 51.50 | 15.9 | 91.6 | 82.2 | 127 | 169 | 392 | 7.90 |
| AR3951-14 | 11.60 | 12.9 | 75.50 | 0.0 | 90.7 | 82.8 | 107 | 193 | 416 | 9.20 |
| AR3951-15 | 9.50 | 0.0 | 90.50 | 0.0 | 88.6 | 85.1 | 158 | 207 | 329 | 6.25 |
| ULRG | 58.30 | 0.4 | 30.40 | 10.9 | 107.0 | 95.7 | 160 | 218 | 229 | 5.35 |
| G3297-PJ | 40.90 | 11.1 | 48.00 | 0.0 | 96.4 | 85.2 | 120 | 214 | 339 | 8.20 |
| A/O 1111 | 19.50 | 4.1 | 76.40 | 0.0 | 90.6 | 84.4 | 123 | 196 | 282 | 8.80 |
| A/O 2222 | 48.30 | 21.0 | 15.40 | 15.3 | 99.0 | 86.1 | 125 | 221 | 356 | 8.80 |
| A/O AVE | 30.70 | 9.5 | 59.80 | 0.0 | 92.2 | 82.7 | 112 | 218 | 315 | 8.70 |
| ARCO EC-1 | 20.70 | 10.8 | 61.40 | 7.1 | 92.8 | 84.0 | 125 | 198 | 348 | 8.20 |
| SU2000E | 40 | 9 | 45.3 | 5.7 | 97.9 | 86.7 | 139 | 224 | 321 | 8.0 |

The fuels were tested in random order with no back to back runs of the same fuel. At first, only the 15 test fuels (designated AR3951-1 through AR3951-15) were run, in random order, and all more than once. However, every fifth run was conducted with fuel G3297-PJ as a control to evaluate systematic error. Each fuel was tested in accordance with the Federal Test Procedure except that (1) instead of allowing the engine between tests to cool down in still air for 10 to 12 hours at 68° to 86° F. (20.0° to 30.0° C.), the engine was subjected for 4.75 hours to a 70° F. (21.1° C.) wind of 50 miles per hour (80.5 km/hr) and (2) instead of a Clayton dynamometer, a General Electric dynamometer was used. It will be noted that the 15 test fuels were purposely blended to provide widely different values for the ten properties shown in Table 2. The emissions data derived from combusting the 15 different test fuels were then analyzed by computer program using the SAS system commercially available from SAS Institute Inc. In this program, the results of the runs with the 15 different fuels were regressed against each of the 10 variables shown in Table 2, as well as against all possible combinations thereof, searching for an equation for each of the three pollutants of interest (NOx, CO, and hydrocarbons) defined by the minimum number of variables that gives the best surface fit based on the R squared value. As a result, the Equations 4, 5, and 6 hereinbefore presented were derived as the equations which best define the amount of pollutants (in grams per mile) emitted as a function of the properties of the fuel combusted in the 1988 Regency vehicle.

After developing the foregoing equation, the other fuels shown in Table 2 were tested, most in multiple runs, and again with the G3297-PJ fuel being used in every fifth run. These fuels were tested for the purpose of checking the accuracy of the foregoing equations in forecasting emissions for new fuel, i.e., they were used as "check fuels."

The emissions data for all runs—the test, control, and check fuels—as well as the calculated emissions according to the foregoing developed equations, are tabulated in Table 3, with it being specifically noted that the order shown in Table 3 is not the exact order in which the fuels were tested.

TABLE 3

| Exp. | Fuel Designation | CO g/mile | NOx g/mile | HC g/mile | Calculated CO g/mile | Calculated NOx g/mile | Calculated HC g/mile |
|---|---|---|---|---|---|---|---|
| 1 | AR3951-1 | 1.106 | 0.196 | 0.100 | 1.593 | 0.203 | 0.131 |
| 2 | AR3951-2 | 0.948 | 0.186 | 0.094 | 1.638 | 0.201 | 0.127 |
| 3 | AR3951-3 | 1.590 | 0.264 | 0.145 | 2.226 | 0.271 | 0.179 |
| 4 | AR3951-4 | 2.228 | 0.252 | 0.193 | 2.458 | 0.235 | 0.194 |
| 5 | AR3951-5 | 2.034 | N.D. | 0.157 | 1.938 | 0.218 | 0.146 |
| 6 | AR3951-6 | 1.637 | 0.280 | 0.143 | 1.664 | 0.293 | 0.133 |
| 7 | AR3951-7 | 2.335 | 0.232 | 0.166 | 2.238 | 0.233 | 0.147 |
| 8 | AR3951-8 | 1.374 | 0.257 | 0.118 | 1.687 | 0.278 | 0.135 |
| 9 | AR3951-9 | 2.068 | 0.286 | 0.165 | 2.182 | 0.281 | 0.177 |
| 10 | AR3951-10 | 1.357 | 0.307 | 0.134 | 1.611 | 0.318 | 0.162 |
| 11 | AR3951-11 | 3.752 | 0.273 | 0.268 | 3.089 | 0.269 | 0.264 |
| 12 | AR3951-12 | 1.738 | 0.278 | 0.154 | 1.867 | 0.233 | 0.134 |
| 13 | AR3951-13 | 2.275 | 0.311 | 0.159 | 1.678 | 0.295 | 0.133 |
| 14 | AR3951-14 | 1.959 | 0.271 | 0.147 | 1.737 | 0.259 | 0.148 |
| 15 | AR3951-15 | 1.654 | 0.190 | 0.114 | 1.628 | 0.183 | 0.133 |
| 16 | ULRG | 1.901 | 0.200 | 0.142 | 2.096 | 0.208 | 0.127 |
| 17 | AR3951-14 | 1.708 | 0.255 | 0.156 | 1.737 | 0.259 | 0.148 |
| 18 | G3297-PJ | 2.267 | 0.273 | 0.187 | 2.059 | 0.262 | 0.160 |
| 19 | G3297-PJ | 1.784 | 0.254 | 0.167 | 2.059 | 0.262 | 0.160 |
| 20 | G3297-PJ | 1.975 | 0.288 | 0.160 | 2.059 | 0.262 | 0.160 |
| 21 | G3297-PJ | 2.265 | 0.263 | 0.180 | 2.059 | 0.262 | 0.160 |
| 22 | AR3951-1 | 1.269 | 0.200 | 0.137 | 1.593 | 0.203 | 0.131 |
| 23 | AR3951-1 | 1.535 | 0.200 | 0.135 | 1.593 | 0.203 | 0.131 |

| Exp. | Fuel Designation | FTP CO Emissions | FTP NOx Emissions | FTP HC Emissions | Calculated CO Emissions | Calculated NOx Emissions | Calculated HC Emissions |
|---|---|---|---|---|---|---|---|
| 24 | AR3951-2 | 1.253 | 0.163 | 0.133 | 1.638 | 0.201 | 0.127 |
| 25 | AR3951-3 | 1.692 | 0.244 | 0.148 | 2.226 | 0.271 | 0.179 |
| 26 | AR3951-4 | 2.835 | 0.274 | 0.235 | 2.458 | 0.235 | 0.194 |
| 27 | AR3951-5 | 1.764 | 0.250 | 0.159 | 1.938 | 0.218 | 0.146 |
| 28 | AR3951-6 | 1.338 | 0.268 | 0.115 | 1.664 | 0.293 | 0.133 |
| 29 | AR3951-7 | 2.059 | 0.223 | 0.146 | 2.238 | 0.233 | 0.147 |
| 30 | AR3951-8 | 1.633 | 0.271 | 0.140 | 1.687 | 0.278 | 0.135 |
| 31 | AR3951-9 | 1.952 | 0.281 | 0.157 | 2.182 | 0.281 | 0.177 |
| 32 | AR3951-11 | 3.443 | 0.237 | 0.272 | 3.089 | 0.269 | 0.264 |
| 33 | AR3951-12 | 1.959 | 0.266 | 0.146 | 1.867 | 0.233 | 0.134 |
| 34 | AR3951-13 | 2.127 | 0.320 | 0.156 | 1.678 | 0.295 | 0.133 |
| 35 | AR3951-14 | 2.552 | 0.284 | 0.182 | 1.737 | 0.259 | 0.148 |
| 36 | G3297-PJ | 2.240 | 0.263 | 0.204 | 2.059 | 0.262 | 0.160 |
| 37 | G3297-PJ | 2.059 | 0.240 | 0.168 | 2.059 | 0.262 | 0.160 |
| 38 | G3297-PJ | 2.322 | 0.278 | 0.172 | 2.059 | 0.262 | 0.160 |
| 39 | G3297-PJ | 1.890 | 0.286 | 0.169 | 2.059 | 0.262 | 0.160 |
| 40 | G3297-PJ | 2.339 | 0.252 | 0.192 | 2.059 | 0.262 | 0.160 |
| 41 | A/O 1111 | 1.641 | 0.296 | 0.173 | 1.579 | 0.222 | 0.129 |
| 42 | A/O 2222 | 1.999 | 0.251 | 0.172 | 2.417 | 0.345 | 0.189 |
| 43 | A/O AVE | 2.162 | 0.298 | 0.210 | 1.798 | 0.248 | 0.145 |
| 44 | A/O AVE | 2.476 | 0.274 | 0.167 | 1.798 | 0.248 | 0.145 |
| 45 | ARCO EC-1 | 1.651 | 0.271 | 0.139 | 1.810 | 0.257 | 0.146 |
| 46 | ARCO EC-1 | 1.517 | 0.255 | 0.139 | 1.810 | 0.257 | 0.146 |
| 47 | SU2000E | 1.738 | 0.203 | 0.166 | 2.104 | 0.256 | 0.164 |
| 48 | AR3951-15 | 1.511 | 0.244 | 0.152 | 1.553 | 0.172 | 0.125 |
| 49 | G3297-PJ | 1.862 | 0.284 | 0.161 | 2.059 | 0.262 | 0.160 |
| 50 | AR3951-5 | 2.012 | 0.261 | 0.201 | 1.938 | 0.218 | 0.146 |
| 51 | A/O 1111 | 1.545 | 0.293 | 0.224 | 1.579 | 0.222 | 0.129 |
| 52 | A/O 2222 | 1.963 | 0.246 | 0.157 | 2.417 | 0.345 | 0.189 |
| 53 | ULRG | 1.769 | 0.217 | 0.139 | 2.096 | 0.208 | 0.127 |

The multiple test emissions data for each of the check fuels and the control fuel were then averaged, set against the calculated values, the deviation from the calculated value then determined, and compared against the standard deviation, which in turn was calculated from only the data pertaining to the control fuel G3297-PJ. These data are set forth in the following Table 4:

TABLE 4

| Emis. | Fuel | Actual g/mi | Calculated g/mi | Deviation | Standard Deviation |
|---|---|---|---|---|---|
| CO | ULRG | 1.835 | 2.096 | 0.261 | 0.205 |
| CO | G3297-PJ | 2.127 | 2.059 | 0.067 | 0.205 |
| CO | Arco EC1 | 1.584 | 1.810 | 0.226 | 0.205 |
| CO | A/O 1111 | 1.593 | 1.579 | 0.014 | 0.205 |
| CO | A/O 2222 | 1.981 | 2.417 | 0.436 | 0.205 |
| CO | SU2000E | 1.738 | 2.104 | 0.366 | 0.205 |
| CO | A/O AVE | 2.319 | 1.798 | 0.521 | 0.205 |
| NOx | ULRG | 0.209 | 0.207 | 0.002 | 0.0162 |
| NOx | G3297-PJ | 0.266 | 0.261 | 0.005 | 0.0162 |
| NOx | Arco EC1 | 0.263 | 0.256 | 0.007 | 0.0162 |
| NOx | A/O 1111 | 0.295 | 0.222 | 0.073 | 0.0162 |
| NOx | A/O 2222 | 0.249 | 0.345 | 0.096 | 0.0162 |
| NOx | SU2000E | 0.203 | 0.256 | 0.053 | 0.0162 |
| NOx | A/O AVE | 0.286 | 0.248 | 0.038 | 0.0162 |
| HC | ULRG | 0.141 | 0.127 | 0.014 | 0.0142 |
| HC | G3297-PJ | 0.178 | 0.160 | 0.017 | 0.0142 |
| HC | Arco EC1 | 0.139 | 0.146 | 0.007 | 0.0142 |
| HC | A/O 1111 | 0.198 | 0.129 | 0.069 | 0.0142 |
| HC | A/O 2222 | 0.165 | 0.189 | 0.024 | 0.0142 |
| HC | SU2000E | 0.166 | 0.164 | 0.002 | 0.0142 |
| HC | A/O AVE | 0.189 | 0.145 | 0.044 | 0.0142 |

It will be seen that, in most cases, the deviations shown in Table 4 are well within three times the standard deviation. In turn, this means that the equations accurately define the scientific phenomena at work within normal realms of variabilities.

EXAMPLE 2

In this example, 22 gasoline fuels, including 15 test fuels A through N and P, one control fuel, Q, and six check fuels, R, S, T, V, W and X were run in six different automobiles. The properties of the 22 gasolines used are shown in the following Table 5.

TABLE 5

GASOLINE PROPERTIES

| Blend Designation | Aromatics Vol. % by FIA | Olefins Vol. % by FIA | Paraffins Vol. % by FIA | MTBE Vol. % by IR | Research Octane Number | Motor Octane Number | D86 Dist. 10% point (°F.) | D86 Dist. 50% point (°F.) | D86 Dist. 90% point (°F.) | Reid Vapor Pressure psi |
|---|---|---|---|---|---|---|---|---|---|---|
| A | 9.6 | 0.0 | 90.4 | 0.0 | 94.0 | 89.5 | 128 | 206 | 291 | 9.23 |
| B | 5.3 | 0.0 | 94.7 | 0.0 | 91.1 | 87.4 | 106 | 178 | 290 | 11.45 |
| C | 48.8 | 10.3 | 41.0 | 0.0 | 97.0 | 84.7 | 122 | 225 | 300 | 9.14 |
| D | 46.6 | 11.4 | 42.1 | 0.0 | 96.2 | 84.0 | 147 | 236 | 334 | 6.63 |
| E | 39.4 | 0.4 | 60.1 | 0.0 | 97.3 | 83.2 | 164 | 219 | 271 | 6.46 |
| F | 9.8 | 16.8 | 73.3 | 15.9 | 92.0 | 83.0 | 121 | 161 | 231 | 9.35 |
| G | 32.8 | 0.6 | 66.6 | 13.7 | 96.6 | 87.5 | 107 | 194 | 296 | 11.54 |
| H | 12.7 | 15.0 | 72.3 | 14.0 | 94.3 | 84.8 | 119 | 180 | 302 | 9.88 |
| I | 46.4 | 12.6 | 41.0 | 0.0 | 97.3 | 84.9 | 126 | 220 | 294 | 8.73 |
| J | 4.8 | 6.2 | 89.1 | 0.0 | 93.9 | 84.9 | 119 | 188 | 290 | 9.65 |
| K | 45.6 | 13.6 | 40.8 | 0.0 | 95.9 | 83.9 | 135 | 274 | 370 | 7.60 |
| L | 31.0 | 0.2 | 68.8 | 14.4 | 93.3 | 85.6 | 125 | 206 | 262 | 9.43 |
| M | 15.9 | 15.3 | 68.8 | 15.8 | 92.1 | 82.9 | 114 | 157 | 368 | 9.77 |
| N | 12.8 | 11.6 | 75.6 | 0.0 | 90.7 | 83.2 | 107 | 185 | 403 | 10.51 |
| P | 10.6 | 0.0 | 89.4 | 0.0 | 89.7 | 85.8 | 144 | 204 | 318 | 7.07 |
| Q | 31.8 | 9.9 | 58.3 | 0.0 | 92.1 | 82.7 | 129 | 220 | 331 | 8.31 |
| R | 52.0 | 21.9 | 26.1 | 14.6 | 98.8 | 85.5 | 130 | 224 | 358 | 8.37 |
| S | 21.1 | 3.9 | 75.0 | 0.0 | 9.10 | 84.3 | 129 | 199 | 284 | 8.44 |
| T | 30.2 | 0.0 | 69.8 | 0.0 | 88.5 | 81.2 | 127 | 182 | 293 | 8.00 |
| V | 23.3 | 6.0 | 70.7 | 0.0 | 92.0 | 83.5 | 132 | 196 | 319 | 7.96 |
| W | 25.6 | 11.8 | 62.5 | 10.1 | 97.7 | 86.7 | 134 | 215 | 335 | 8.12 |
| X | 38.5 | 0.0 | 61.5 | 0.0 | 94.8 | 85.0 | 123 | 211 | 326 | 7.63 |

The automobiles (and accompanying engines) utilized were:

1. 1988 Oldsmobile 98 Regency—3.8 liter V-6
2. 1989 Ford Taurus—3.0 liter V-6
3. 1990 Toyota Camry—2.0 liter 4 cylinders
4. 1989 GM Cutlass Calais—3.8 liter V-6
5. 1990 Ford Lincoln—5.0 liter V-8
6. 1990 Dodge Shadow—2.5 liter 4 cylinders The fuels were tested in the foregoing automobiles in the same manner as described in Example 1 except that the control fuel was used in every sixth run and the Federal Test Procedure (FTP) was followed exactly. Each fuel was tested at least twice, many three times, and some four times, in each of the vehicles.

Figure 2:
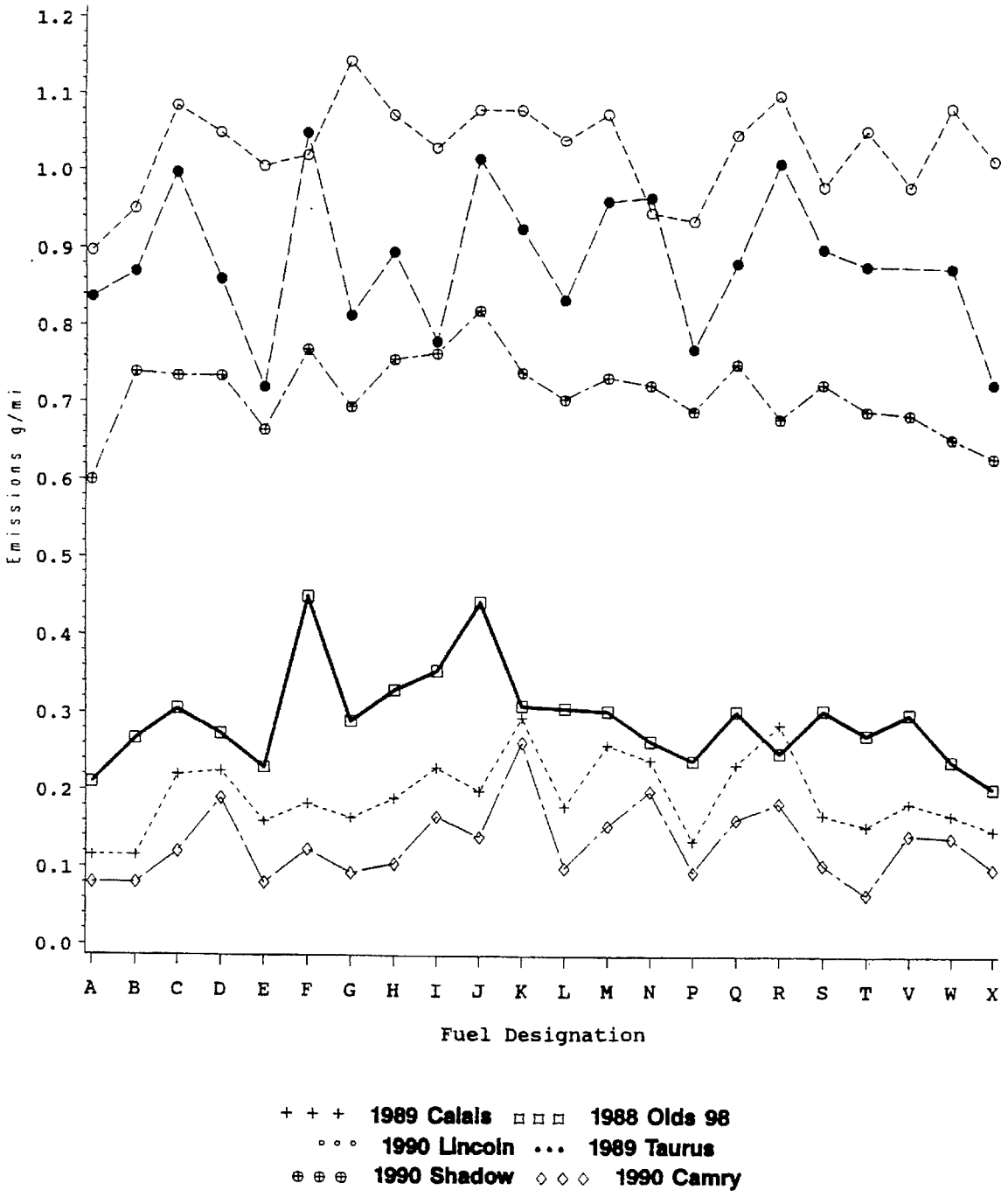
FIG. 2 is a graph of NOx emission values for 22 different fuels tested in six different automobiles. Each data point on the graph is an average of a plurality of runs for each fuel-automobile combination.
Figure 3:
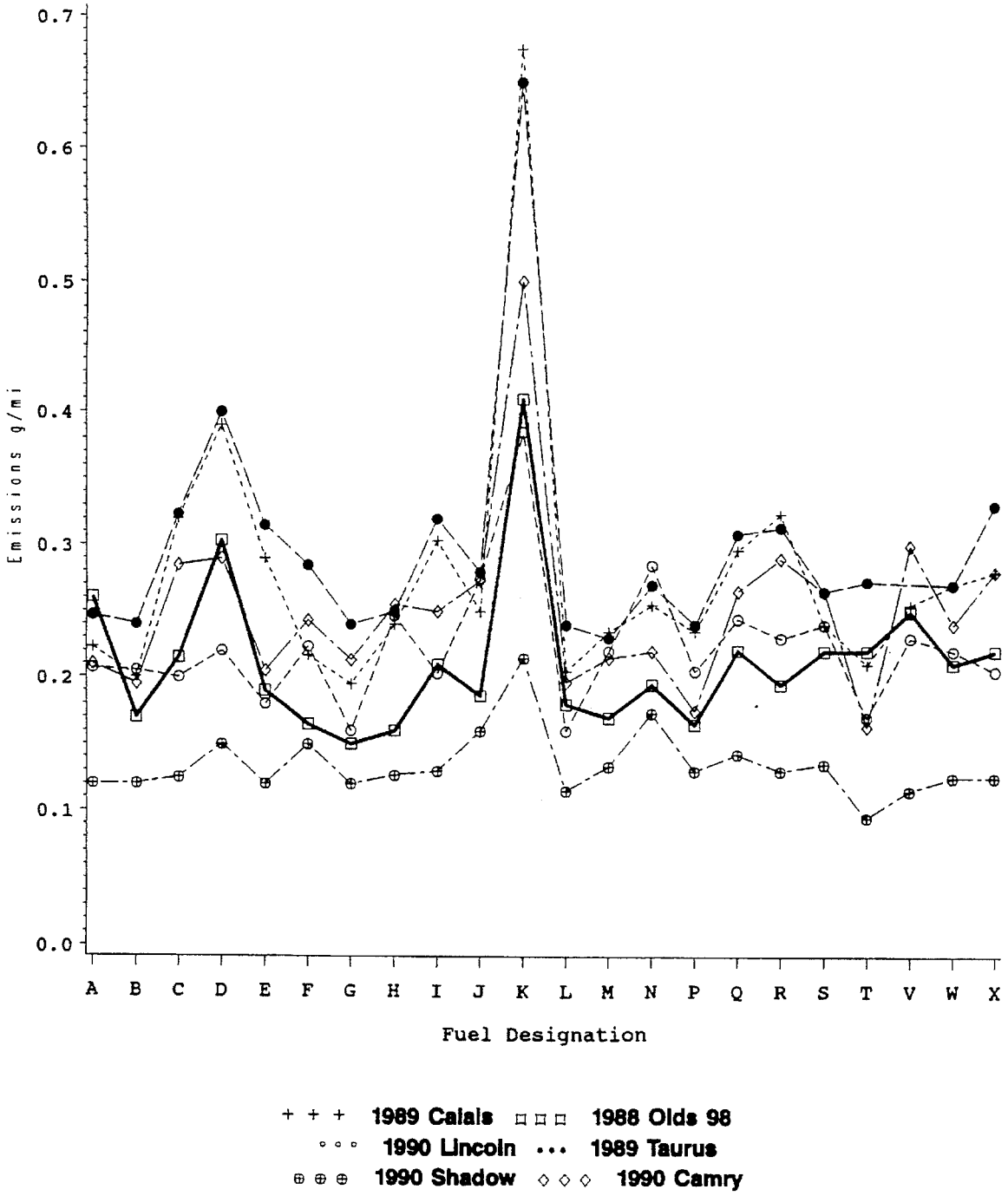
FIG. 3 is a graph of hydrocarbon emission values for 22 different fuels tested in six different automobiles. Each data point on the graph is an average of a plurality of runs for each fuel-automobile combination.

The CO, NOx, and hydrocarbon emission data obtained by the Federal Test Procedure for each fuel in a given automobile were averaged, and then plotted respectively in the graphs in FIGS. 1, 2, and 3. (Thus, each data point in FIGS. 1 through 3 is an average of the values obtained for each automobile with the specified fuel.) Given the great number of fuels and automobiles tested, each of the three graphs shows a remarkable similarity in the overall shape of the curves in the graphs. It is clearly evident from these figures that the general effect of a given fuel is the same for different vehicles, with only the magnitude of the effect varying.

EXAMPLE 3

In this example, Example 2 was repeated except on the following automobiles (and accompanying engines):

1. 1985 Ford Tempo—2.3 liter 4 cylinders
2. 1984 GM Caprice—5.0 liter V-8

3. 1988 Honda Accord—2.0 liter 4 cylinders
4. 1985 GM Suburban—5.7 liter V-8

Figure 4:
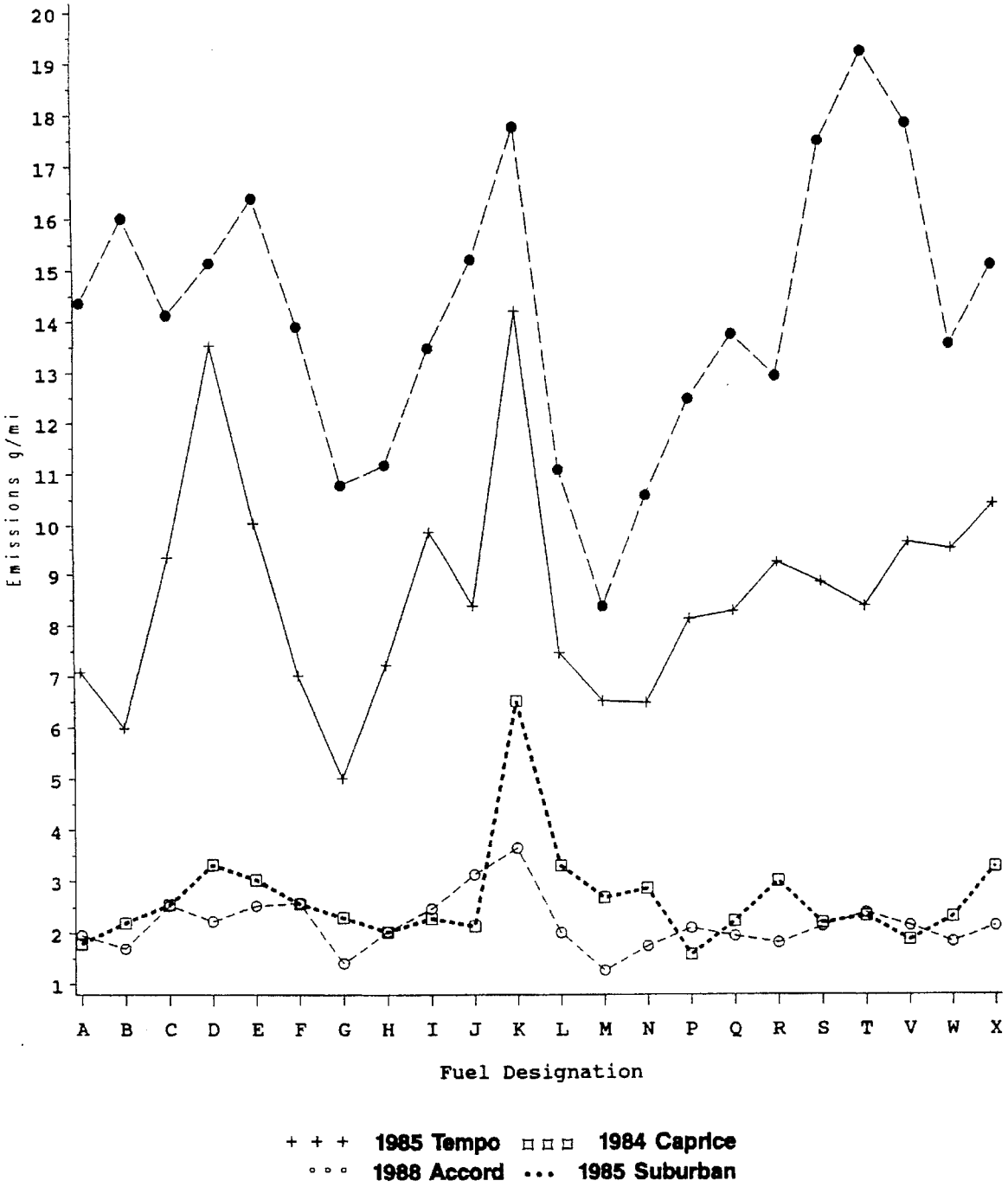
FIG. 4 is a graph of CO emission values for 22 different fuels tested in four different automobiles. Each data point on the graph is an average of a plurality of runs for each fuel-automobile combination.
Figure 5:
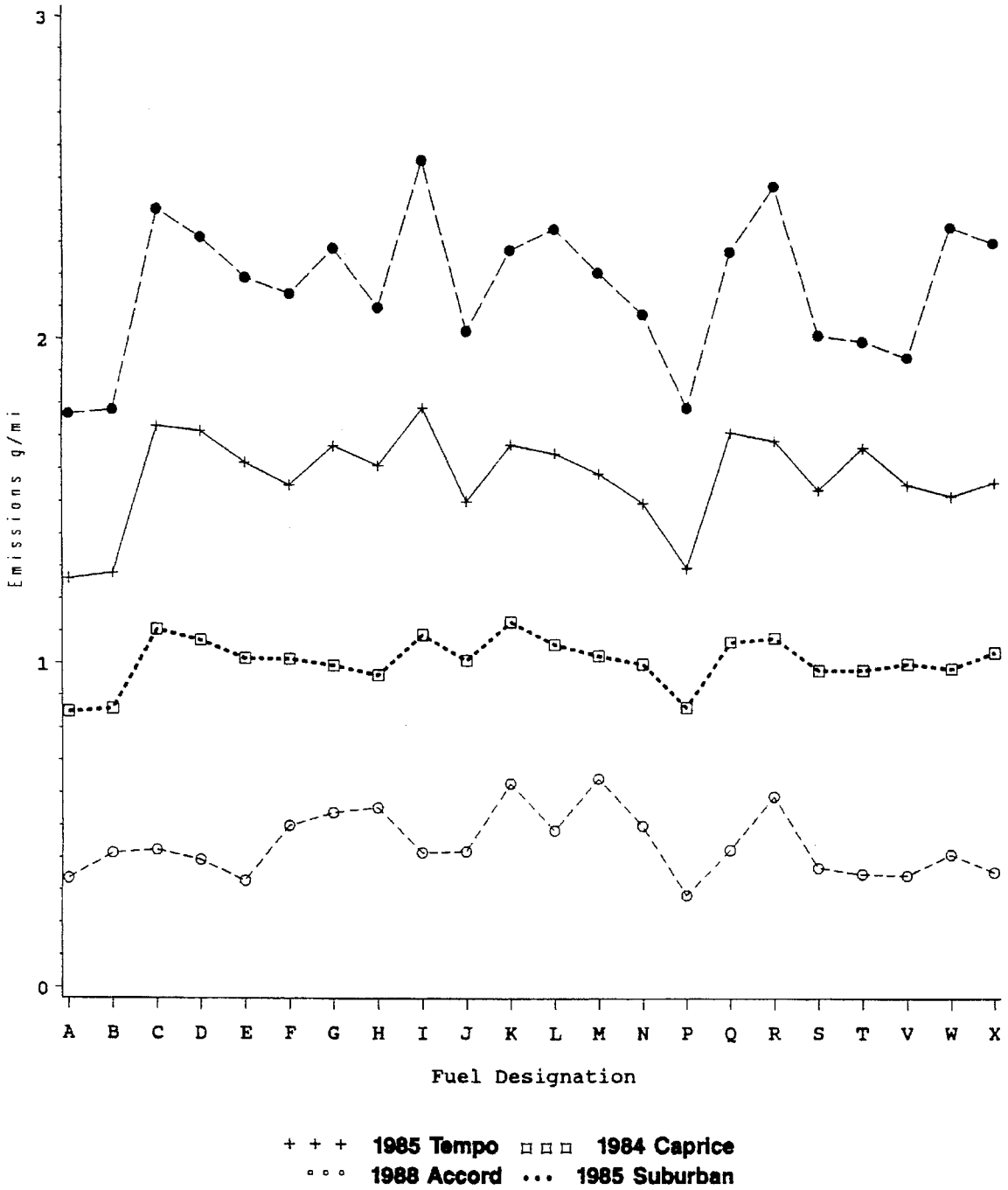
FIG. 5 is a graph of NOx emission values for 22 different fuels tested in four different automobiles. Each data point on the graph is an average of a plurality of runs for each fuel-automobile combination.
Figure 6:
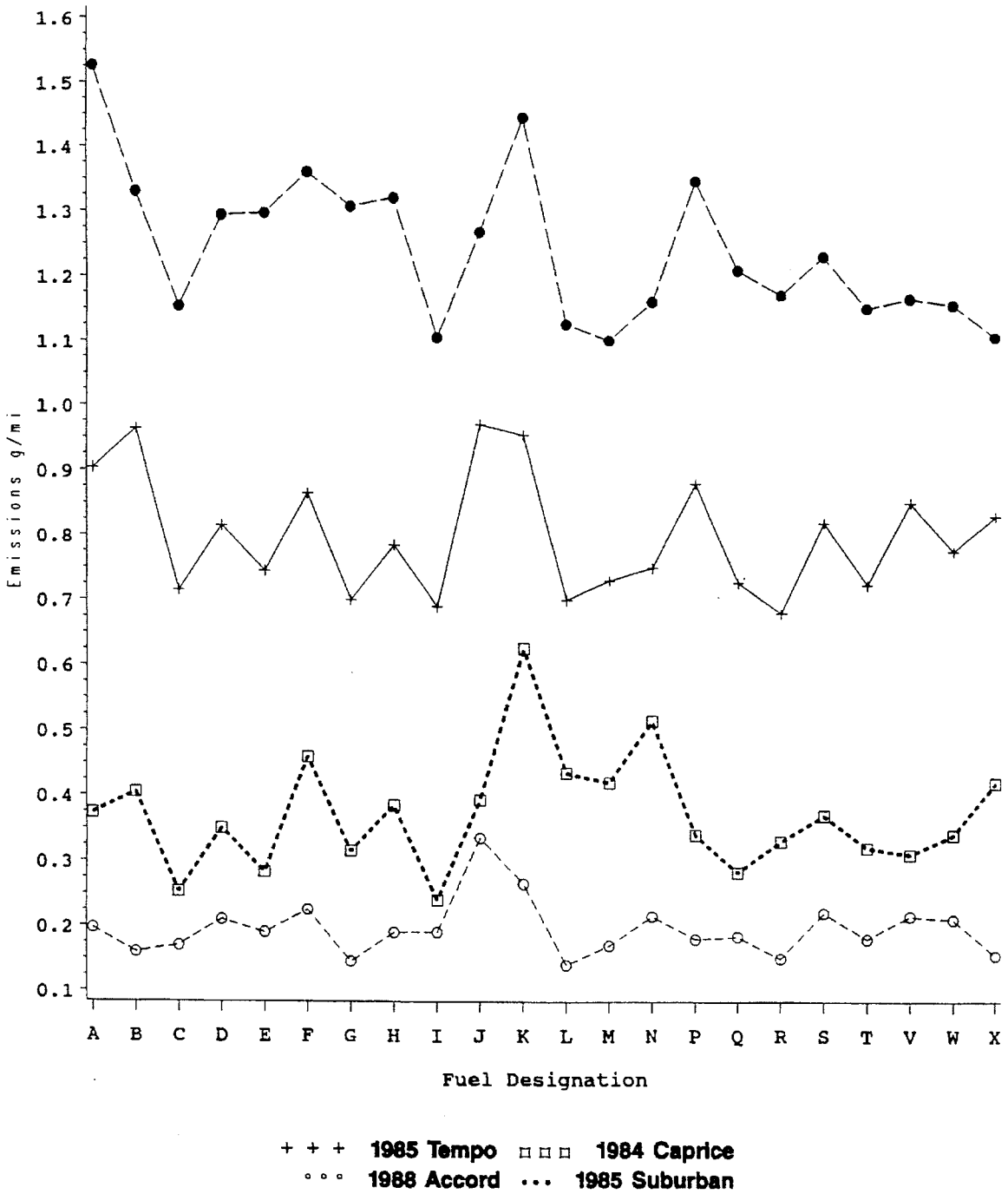
FIG. 6 is a graph of hydrocarbon emission values for 22 different fuels tested in four different automobiles. Each data point on the graph is an average of a plurality of runs for each fuel-automobile combination.

The fuels were tested in the foregoing automobiles in the same manner as described in Example 2. The emission data obtained were averaged and plotted on FIGS. 4 through 6, and once again, the results show a remarkable consistency in the effects of a given fuel.

In all, for Examples 2 and 3, a total of over 500 FTP runs was made so as to provide a large enough data base to ensure the validity of the results. It should be noted that Examples 2 and 3, and the figures of the drawing pertaining to each, focused on automobiles and engines which were dissimilar in many respects. However, the automobiles in Example 2 all had adaptive learning computers with fuel-to-air feedback control loops whereas those in Example 3 did not. The figures thus show that groups of cars with these similar engineering features behave similarly to changes in the fuel, which in turn shows the universality of one of the inventive concepts. The automobiles of Examples 2 and 3 were chosen because of their high commercial sales. The automobiles of Example 2 were all relatively recent models while those of Example 3 were generally older. All but one of the Example 3 automobiles had carburetor systems whereas all of those in Example 2 had fuel injection systems.

The data derived in Examples 2 and 3 were analyzed by the same computer program as described for Example 1, searching, as in Example 1, for an equation for each automobile which would provide a value for NOx, CO, and hydrocarbon emissions as a function of the minimum number of fuel properties. Not every equation so derived conformed to the generalized equation set forth hereinbefore; some, for example, showed a minor increase in hydrocarbon emissions with increases in aromatics content. Nevertheless, many of the equations did fit the generalized equation set forth hereinbefore, and more importantly, the data overall validated the fact that the most important factors as shown in the generalized Equations 1 to 3 proved almost universally most significant for each automobile.

More specifically, where much of the previous discussion was limited to 1988 Oldsmobile Regency 98 and similar automobiles, the data in tables 7 to 9—which were obtained from the data from which FIGS. 1 to 6 were derived—indicate that some variables universally or essentially universally affect emissions from automobile engines, others are limited to one or only a few vehicles, and yet others affect a particular pollutant in about 50% of the vehicles.

More specifically still, in the tables of FIGS. 7 to 9 there are indicated for each automobile tested in Examples 2 and 3those factors which proved to be significant in increasing the specified emission when the variable is increased (as indicated by one or more + signs) and significant in decreasing the specified emission when the variable is increased (as indicated by one or more − signs). Those variables which dramatically affect emissions (i.e., principal factors) are indicated by more than one + or − signs, with increasing numbers of + or − signs indicating increased significance for that variable. Those variables which are of least importance among the significant variables are indicated by a (+) or (−) sign. (Also shown in FIGS. 7 to 9 are the values obtained by summing the square of all the data predicted by the particular equation for each automobile for a particular pollutant and dividing by the sum of the square of all the data actually obtained for the automobile. It will be recognized that, the closer such value is to 1.0, the better the equation defines the effect under consideration. In the case of FIGS. 7 to 9, 29 of the 30 values are above 0.9 and only one is below—and that scarcely below at 0.894. Accordingly, it was determined that the equations for each of the automobiles was statistically accurate, and that therefore the data derived therefrom—as shown in FIGS. 7 to 9—would meaningfully point to those variables which would have a statistically significant effect upon the emission characteristics from a given automobile in FIGS. 7 to 9.)

When the data of Examples 2 and 3 are analyzed as shown in FIGS. 7 to 9, the following facts stand out as most significant:

1. Decreases in the 50% D-86 Distillation Point caused decreases in CO and hydrocarbon emissions for all of the automobiles.
2. Decreases in the Olefin Content caused reductions in NOx emissions from all the vehicles.
3. Decreases in the 10% D-86 Distillation Point caused reductions in NOx emissions from all the vehicles.
4. Decreases in Reid Vapor Pressure caused reductions in NOx emissions from all the vehicles but one.

Accordingly, from the data in FIGS. 7 to 9, it can be seen that for automobiles in general that decreasing any of the variables 1 to 4 above will have a positive effect, especially for any large population of automobiles. In turn, it can be appreciated that the preferred fuels of the invention will be prepared (e.g., by appropriate blending in a refinery) so as to decrease each of the foregoing variables, and in particular, the 50% D-86 Distillation Point, the Reid Vapor Pressure, and the Olefin content, all three of which are more significantly (and easily) decreasable in refinery practice than the 10% D-86 distillation Point.

Presently, the most commercially attractive fuel producible in accordance with the invention has the following properties: (1) Olefin Content of 0%; (2) Reid Vapor Pressure of 7.5 psi (0.51 atm) maximum; and (3) 50% D-86 distillation point greater than 180° F. (82° C.) but no greater than 205° F. (96° C.).

Where it is desired to take advantage of the emission reductions attainable by varying the 50% D-86 distillation point, this value usually is no greater than 215° F. (101.6° C.), e.g., no greater than 210° F. (98.9° C.) but preferably is no greater than 205° F. (96.1° C.), e.g., less than 203° F. (95° C.), or less than 200° F. (93.3° C.), or less than 198° F. (92.2° C.), more preferably less than 195° F. (90.6° C.), e.g., less than 193° F. (89.4° C.), or less than 190° F. (87.8° C.), or less than 187° F. (86.1° C.), and most preferably less than 185° F. (85.0° C.), e.g., less than 183° F. (83.9° C.). In general, the 50% D-86 Distillation Point is above 170° F. (77° C.) and most often above 180° F. (82.2° C.).

Where it is desired to take advantage of the emission reductions attainable by varying the olefin content, this value is generally maintained less than 15 volume percent, with decreasing values providing progressively improved results. Thus, it is contemplated that each unit reduction, e.g., to values below 14, below 13, below 12, below 11, below 10, below 9, below 8, below 7, below 6, below 5, below 4, below 3, below 2, below 1 providing progressively better results, with values of 0.5 or less and essentially zero providing the best results possible.

Where it is desired to take advantage of reductions attainable by reducing the Reid Vapor Pressure, the gasoline will generally have a Reid Vapor Pressure specification of 8.0 psi (0.54 atm) max., most often less than 8.0 psi (0.54 atm), preferably no greater than 7.5 psi (0.51 atm), even more preferably no greater than 7.0 psi (0.48 atm), and most preferably of all, no greater than 6.5 psi (0.44 atm).

Where the emissions reductions attainable by reducing the 10% D-86 Distillation Point is desired, this value is most often maintained no greater than 140° F. (71° C.), preferably no more than 135° F. (57.2° C.), even more preferably no more than 130° F. (54° C.), and most preferably of all, no more than 122° F. (48.9° C.).

It can also be seen from the data in FIG. 7 that the paraffin content has an effect on 50% of the automobiles with respect to reducing CO, i.e., progressively increasing the paraffin content progressively decreases the CO emitted. Accordingly, where it is desired to take advantage of these facts, the paraffin content would be increased to above 40 volume percent, usually above 50 volume percent, most often to above 65 volume percent, preferably above 68 volume percent, more preferably above 70 volume percent, e.g., above 72 volume percent, even more preferably above 75 volume percent, e.g., above 77 volume percent, and most preferably, above 80 volume percent, e.g., above 82 volume percent, and most preferably of all, above 85 volume percent, e.g., above 87 or 90 volume percent.

Likewise, 60% of the automobiles shown in FIG. 9 evidenced reductions in hydrocarbon emissions when the aromatics content was increased. Where it is desired to take advantage of this fact, the aromatics content would be increased to at least 35 volume percent, preferably at least 40 volume percent.

In view of the information presented above, a petroleum refiner may take advantage of the invention by blending hydrocarbon streams boiling in the gasoline range of 77° F. (25° C.) to about 437° F. (225° C.) so as to affect at least one (and preferably more than one) of the properties of one of the streams as follows:

(1) decrease the 50% D-86 Distillation Point;
(2) decrease the olefin content;
(3) increase the paraffin content;
(4) decrease the Reid Vapor pressure;
(5) increase the Research Octane Number;
(6) decrease the 10% D-86 Distillation Point;
(7) decrease the 90% D-86 Distillation Point; and
(8) increase the aromatics content.

In such case, the petroleum refiner is, in essence, using the information provided by the present invention so as to convert a given gasoline stream into another with better properties with respect to CO, NOx, and/or hydrocarbon emissions.

It will also follow that one can increase or decrease any combination of the eight properties listed above, i.e., at least two, at least three, at least four, etc., of the properties can be increased or decreased in the direction indicated above, as well as all eight. In addition, the greater any individual property is changed in the direction indicated, the better the result, with at least 10% changes being normally used, and preferably at least 20%. In addition, one can change the property by difference instead of by percentage, for example, affecting the properties as follows:

(a) decreasing the 50% D-86 distillation point by at least 20° F. (11.1° C.) or by at least 40° F. (22.1° C.);
(b) decreasing the Reid Vapor Pressure by at least 1 psi (0.07 atm.) or by at least 2 psi (0.14 atm.);
(c) decreasing the olefin content by at least 3 volume percent or by at least 5 volume percent;
(d) increasing the paraffin content by at least 10 volume percent by at least 20 volume percent.
(e) decreasing the 10% D-86 distillation point by at least 10° F. (5.5° C.) or by at least 20° F. (11.1° C.); and
(f) increasing the aromatics content by at least 10 volume percent. Moreover, as would stand to reason, one could also elect to employ any combination of (a) to (f) above to produce the desired lower emission gasoline product.

While the invention may be used to advantage even on a small volume basis, e.g., a single automobile operating with a fuel composition of the invention for a week or for at least 200 consecutive miles, it is clear that the benefits offered by the invention are best taken advantage of when a large number of automobiles operating with spark induced internal combustion engines requiring a gasoline fuel are powered with the fuel of the invention. In fact, the benefits of the invention increase directly with the number of automobiles which employ the fuel. Therefore, in one embodiment of the invention, on a given day, and preferably on a daily basis over a period of at least one month, at least 1,000 and more preferably at least 10,000 automobiles are provided with a fuel composition of the invention—and even more preferably it is desired that the 1000+or 10,000+automobiles be provided with such fuel in a highly congested area, e.g., within the limits of a city or county encompassing a population of 500,000 or more people. Most advantageously, the amount of fuel dispensed into automobile fuel tanks within the city or county should be sufficient to effect a noticeable decrease in the amount of one or more of NOx, CO, and hydrocarbons in the air. At the present time, it is believed that, if as little as 10% of the gasoline fuel supplied to automobiles within a given city or county were a composition of the invention, a decrease in the pollution caused by one or more of these components would be obtained (assuming no significant increase in the automobile traffic within said city or county). Higher percentages, e.g., at least 25%, will yield still better results. If at least 50% of the fuel sold within a given city or county on a daily basis were a composition of the invention, it is believed, based on the data in the Examples hereinabove, that reductions in auto emissions of CO, NOx, and/or hydrocarbons at least as high as 20% as compared to the typical gasoline fuel could be observed (depending, of course, on how each of the variables is adjusted in the appropriate direction and the magnitude of such changes). Yet better results can be expected if at least 75%, even more preferably at least 90%, of the gasoline fuel were supplied on a given day from gasoline service stations within a given geographical area, e.g., a governmental district such as a city or county. Alternatively, if the same percentages pertained to a specific unit area, e.g., any 5,000 square mile (12,948 square kilometer) or 10,000 square mile (25,895 square kilometer) or any 50,000 square mile (129,476 square kilometer) area, one would expect to see reductions in one or more of CO, NOx, and hydrocarbons.

In any event, because the benefits of the invention are best realized when the gasoline fuel of the invention is supplied and combusted on a large quantity basis (i.e., large volume consumption), it is contemplated that there are many ways by which this can be accomplished, among which the following are merely illustrative:

1. Operating a fleet of automotive vehicles, numbering at least 10, preferably at least 25, with a fuel composition of the invention.
2. Operating a single automobile for an extended period of time, e.g., at least six months, or for at least 2,000 consecutive miles (3,218 kilometers), with a fuel composition of the invention.
3. Consuming at least 500 gallons (1,893 liters) of a fuel composition of the invention in one vehicle.
4. Consuming at least 2,000 gallons (7,570 liters) of a fuel composition of the invention in either one automobile or a fleet of automobiles.

Yet greater consumption can be attained by, for example:

1. Supplying, via gasoline service stations and the like, at least 1,000 vehicles, preferably at least 10,000 vehicles, per day with a fuel composition of the invention.

2. Supplying, via gasoline service stations and the like, at least 10,000,000 gallons (37,850,000 liters) per week of a fuel composition of the invention to automotive vehicles.

In order to supply and consume a gasoline composition of the invention on a large volume basis, it follows that the gasoline composition must be produced at a petroleum refinery or the like in large volumes. Typically, a refinery has a capacity to process at least 20,000 barrels per day (132,500 liters per hour), preferably at least 30,000 barrels per day (198,750 liters per hour), of crude oil and to produce at least 30,000 gallons (113,550 liters), preferably at least 50,000 gallons (189,250 liters), and most preferably at least 100,000 gallons (378,500 liters) of gasoline per day. While the invention would best be taken advantage of if all the gasoline fuel produced in a refinery were a composition of the invention, good results can be obtained if a significant fraction thereof—e.g., at least 10%, were a fuel composition of the invention. In commercial practice, it is contemplated that usual procedures will result in at least 25%, often at least 50%, and sometimes at least 75% of the daily refinery output being a fuel composition of the invention. Such output would then be delivered to gasoline service stations for introduction into automobiles, with, again, the greatest significant advantage being if all the gasoline service stations so supplied—or some significant portion thereof, e.g., at least 25%, more preferably at least 50%, and most preferably at least 75%—are located in a congested area of high population density, e.g., a city or county as described above.

Accordingly, in view of the foregoing, it will be seen that there are many ways of employing the inventive concept on a large volume basis. Obviously, the best results will be obtained when the fuel composition of the invention is so blended in a refinery or the like as to reduce the emissions of hydrocarbons, CO, and NOx to the lowest possible levels, then combusting such fuel in automobiles on a large volume basis over extended periods of time, e.g., at least one month, preferably at least six months, and with the most advantage to be realized in the most densely populated areas, e.g., counties or cities of populations exceeding 1,000,000, or more than 2,500,000, or more than 5,000,000, or, in areas like Los Angeles county, more than 10,000,000 persons. To provide for the needs of such high population density areas, it may be necessary to supply the fuel composition of the invention from more than one refinery, and to deliver it to a large fraction of the gasoline service stations in such area, e.g., at least 25%, preferably at least 50%, most preferably at least 75%, so that a large number of automobiles can be supplied with the inventive fuel on a daily basis, e.g., at least 100,000, preferably at least 500,000 automobiles.

In view of the foregoing, it can be seen that the invention offers many advantages, not the least of which are the obvious health benefits associated with reduced air pollutants emitted to the atmosphere from automobiles, trucks, and other gasoline powered motor vehicles. Additionally, the invention can be put into immediate practice; current refining equipment can be employed to produce the low polluting fuels of the invention. Moreover, the invention offers the petroleum refiner a great deal of flexibility, for the invention is highly adaptable to a wide variety of hydrocarbon refinery streams. More specifically, since the description hereinbefore shows the effect of different variables, the refiner is not constrained to producing one particular fuel, but has several options, depending on what hydrocarbon streams are at hand and what properties of the fuel can be most easily altered.

By offering such flexibility with no needed hardware changes in a refinery, the invention is relatively easy to implement—and all the more so in light of the fact that the invention can be taken advantage of without need for additives specific for reducing polluting emissions. As an example, many current fuels contain methyl tertiary butyl ether as an additive for reducing CO emissions. The present invention, however, requires no methyl tertiary butyl ether to be present. Thus, while the invention in its broadest embodiment encompasses fuels with additives that may aid in reducing such emissions, the advantages of the invention can be obtained without the necessity, for example, of a refinery having to deliberately change its practices to provide for the continuous blending of an emission-reducing additive into the fuel.

The invention, of course, as described hereinbefore, offers significant reductions in NOx, CO, and hydrocarbon emissions. Present indications are that, on a side-by-side basis, preferred fuels of the present invention offer at least a 10%, usually at least a 20%, sometimes at least 40%, reduction in emissions when tested in identical vehicles (e.g., the 1988 Oldsmobile Regency 98 described above) with identical engines and identical catalytic converter systems as compared to results obtained with a typical fuel, for example, the fuel identified in Table 2 as A/O AVE and that in Table 5 as Fuel Q. (These fuels are, in essence, identical, having been made in identical fashion but at different times; the slight differences in results shown in the two tables being within normal tolerance variations.)

It should also be recognized that the invention offers an advantage for automobile manufacturers. As government regulations progressively become more stringent in the amount of pollutants that can be emitted from motor vehicles, the present invention, by providing for a fuel inherently having properties which reduce or minimize such emissions, allows an automobile manufacturer to meet such regulations with fewer—if any—hardware design changes being needed.

It will be understood that reference hereinabove to the "D-86 Distillation Point" refers to the distillation point obtained by the procedure identified as ASTM D 86-82, which can be found in the 1990 Annual Book of ASTM Standards, Section 5, Petroleum Products, Lubricants, and Fossil Fuels, herein incorporated by reference in its entirety.

The FTP (Federal Test Procedure) specified hereinabove refers to Code of Federal Regulations, volume 40, "Protection of the Environment," Subpart B, "Emission Regulations for 1977 and Later Model Year New Light-Duty Vehicles and New Light-Duty Trucks; Test Procedures, herein incorporated by reference in its entirety.

"Reid Vapor Pressure" is a pressure determined by a conventional analytical method for determining the vapor pressure of petroleum products. In essence, a liquid petroleum sample is introduced into a chamber, then immersed in a bath at 100° F. (37.8° C.) until a constant pressure is observed. Thus, the Reid Vapor Pressure is the difference, or the partial pressure, produced by the sample at 100° F. (37.8° C.). The complete test procedure is reported as ASTM test method D 323-89 in the 1990 Annual Book of ASTM Standards, Section 5, Petroleum Products, Lubricants, and Fossil Fuels, herein incorporated by reference in its entirety.

While the invention has been described in conjunction with preferred embodiments thereof, various modifications and substitutions can be made thereto without departing from the spirit and scope of the present invention. The invention has also been described with reference to examples, which are presented for illustration only, and thus no limitation should be imposed other than those indicated by the following claims:

We claim:

1. A method for operating an automotive vehicle having a spark-induced, internal combustion engine and a catalytic converter to yield a reduced amount of NOx, CO, or unburned hydrocarbons as compared to combusting fuel A/O AVE in said engine, the method comprising:

(1) introducing into the engine an unleaded gasoline, suitable for combustion in an automotive engine, having a Reid Vapor Pressure less than 7.5 psi, an octane value of at least 87, a 10% D-86 distillation point no greater than 158° F. a 50% D-86 distillation point no greater than 210° F. and an olefin content less than 10 volume percent; and thereafter (2) combusting the unleaded gasoline in said engine;

(3) introducing at least some of the resultant engine exhaust emissions into the catalytic converter; and (4) discharging emissions from the catalytic converter to the atmosphere.

2. A method for aiding in minimizing air pollution caused at least in part by exhaust emissions from gasoline-powered automobiles equipped with catalytic converters and operating within a geographical area defined by a city and its contiguous area populated by at least 500,000 persons, the geographical area also encompassing a plurality of automotive gasoline service stations, the operation of said automobiles contributing to air pollution in said geographical area, the method, performed by a gasoline supplier delivering at least 100,000 gallons per day of unleaded gasoline as defined below for automotive combustion in the geographical area during a one week time period, comprising:

delivering to at least 25% of the automotive gasoline service stations supplied by said supplier in said geographical area during said one week time period unleaded gasoline yielding, upon combustion, a reduced amount of NOx, CO, and unburned hydrocarbons as compared to Fuel A/O AVE, said unleaded gasoline being suitable for combustion in an automotive engine and having a Reid Vapor Pressure less than 7.5 psi, an octane value of at least 87, a 10% D-86 distillation point no greater than 158° F., a 50% D-86 distillation point no greater than 210° F., and an olefin content less than 10 volume percent.

3. A method for aiding in minimizing air pollution caused at least in part by exhaust emissions from gasoline-powered automobiles equipped with catalytic converters and operating within a contiguous geographical area having significant air pollution, the geographical area also encompassing a plurality of automotive gasoline service stations, the operation of said automobiles contributing to air pollution in said geographical area, the method, performed by a gasoline supplier delivering at least 100,000 gallons per day of unleaded gasoline as defined below for automotive combustion in the geographical area during a one week time period, comprising:

delivering to at least 25% of the automotive gasoline service stations supplied by said supplier in said geographical area during said one week time period unleaded gasoline yielding, upon combustion, a reduced amount of NOx, CO, and unburned hydrocarbons as compared to Fuel A/O AVE, said unleaded gasoline being suitable for combustion in an automotive engine and having a Reid Vapor Pressure less than 7.5 psi, an octane value of at least 87, a 10% D-86 distillation point no greater than 158° F., a 50% D-86 distillation point no greater than 210° F., and an olefin content less than 10 volume percent.

4. A method comprising (1) supplying unleaded gasoline to a fuel tank of an automobile equipped with an engine and a catalytic converter, said unleaded gasoline yielding, upon combustion, reduced emissions of NOx, CO, or unburned hydrocarbons in comparison to fuel A/O AVE, said unleaded gasoline further being suitable for combustion in an automotive engine and having a Reid Vapor Pressure less than 7.5 psi, an octane value of at least 87, a 10% D-86 distillation point no greater than 158° F., a 50% D-86 distillation point no greater than 210° F., and an olefin content less than 10 volume percent;

(2) combusting in said engine fuel drawn from said fuel tank; and (3) passing exhaust gases from said engine through said catalytic converter and thence to the atmosphere.

5. A method as defined in claim 4 wherein said unleaded gasoline has a 90% D-86 distillation point no greater than 315° F.

6. A method as defined in claim 5 wherein said unleaded gasoline has an olefin content less than 8 volume percent.

7. A method as defined in claim 6 wherein said unleaded gasoline has a 50% D-86 distillation point less than 195° F.

8. A method as defined in claim 6 wherein said unleaded gasoline has a 50% D-86 distillation point less than 198° F.

9. A method as defined in claim 6 wherein said unleaded gasoline has a 30% D-86 distillation point less than 200° F.

10. A method as defined in claim 6 wherein said unleaded gasoline has a 50% D-86 distillation point less than 203° F.

11. A method as defined in claim 10 wherein said unleaded gasoline has a 90% D-86 distillation point less than 300° F.

12. A method as defined in claim 6 wherein said unleaded gasoline has a 50% D-86 distillation point no greater than 205° F.

13. A method as defined in claim 6 wherein said unleaded gasoline has a 50% D-86 distillation point less than 208° F.

14. A method as defined in claim 10 wherein said unleaded gasoline has a 90% D-86 distillation point less than 300° F.

15. A method as defined in claim 4 wherein said unleaded gasoline has an olefin content less than 6 volume percent.

16. A method as defined in claim 15 wherein said unleaded gasoline has a 90% D-86 distillation point no greater than 315° F.

17. A method as defined in claim 15 wherein said unleaded gasoline has a 50% D-86 distillation point less than 195° F.

18. A method as defined in claim 17 wherein said unleaded gasoline has a 90% D-86 distillation point less than 300° F.

19. A method as defined in claim 15 wherein said unleaded gasoline has a 50% D-86 distillation point less than 198° F.

20. A method as defined in claim 19 wherein said unleaded gasoline has a 90% D-86 distillation point no greater than 315° F.

21. A method as defined in claim 15 wherein said unleaded gasoline has a 50% D-86 distillation point less than 200° F.

22. A method as defined in claim 21 wherein said unleaded gasoline has a 90% D-86 distillation point less than 300° F.

23. A method as defined in claim 15 wherein said unleaded gasoline has a 50% D-86 distillation point less than 203° F.

24. A method as defined in claim 23 wherein said unleaded gasoline has a 90% D-86 distillation point no greater than 315° F.

25. A method as defined in claim 23 wherein said unleaded gasoline has a 90% D-86 distillation point less than 300° F.

26. A method as defined in claim 15 wherein said unleaded gasoline has a 50% D-86 distillation point no greater than 205° F.

27. A method as defined in claim 26 wherein said unleaded gasoline has a 90% D-86 distillation point no greater than 315° F.

28. A method as defined in claim 15 wherein said unleaded gasoline has a 50% D-86 distillation point less than 208° F.

29. A method as defined in claim 28 wherein said unleaded gasoline has a 90% D-86 distillation point no greater than 315° F.

30. A method as defined in claim 1, 3, 4, 5, or 29 wherein said unleaded gasoline has a 50% D-86 distillation point less than 200° F.

31. A method as defined in claim 1, 3, 4, 5 or 29 wherein said unleaded gasoline has a 50% D-86 distillation point less than 195° F.

32. A method as defined in claim 1, 4, 5, 7, 9, 11, 12, 15, or 29 wherein the octane value of the unleaded gasoline is at least 92.

33. A method as defined in claim 32 wherein the Reid Vapor Pressure of the unleaded gasoline is less than 7.0 psi.

34. A method as defined in claim 3, 4, 6, 14, 17, 20, 21, 25, 26, or 29 wherein the paraffin content of the unleaded gasoline is greater than 70 volume percent.

35. A method as defined in claim 34 wherein the Reid Vapor Pressure of the unleaded gasoline is less than 7.0 psi.

36. A method as defined in claim 35 wherein the octane value of the unleadeded gasoline is at least 92.

37. A method as defined in claim 36 wherein the 10% D-86 distillation point of the unleaded gasoline is no more than 135° F.

38. A method as defined in claim 28 wherein said unleaded gasoline has a 90% D-86 distillation point less than 300° F.

39. A method as defined in claim 1, 2, 3, 4, 5, or 29 wherein said unleaded gasoline has a 50% D-86 distillation point no greater than 205° F.

40. A method as defined in claim 1, 4, 6, 10, 13, 18, 22, 27, or 38 wherein the 10% D-86 distillation point of the unleaded gasoline is less than 140° F.

41. A method as defined in claim 40 wherein the octane value of the unleaded gasoline is at least 92.

42. A method as defined in claim 1, 2, 3, 4, 5, 10, 16, 18, 20, 21, 27, or 38 wherein the Reid Vapor Pressure of the unleaded gasoline is less than 7.0 psi.

43. A method as defined in claim 42 wherein the 10% D-86 distillation point of the unleaded gasoline is no more than 135° F.

44. A method as defined in claim 43 wherein the octane value of the unleaded gasoline is at least 92.

45. A method as defined in claim 2, 3, 4, 7, 11, 15, 21, 27, or 38 wherein the paraffin content of the unleaded gasoline is greater than 65 volume percent.

46. A method as defined in claim 45 wherein the octane value of the unleaded gasoline is at least 92.

47. A method as defined in claim 45 wherein the Reid Vapor Pressure of the unleaded gasoline is less than 7.0 psi.

48. A method as defined in claim 47 wherein the 10% D-86 distillation point of the unleaded gasoline is less than 140° F.

49. A method as defined in claim 48 wherein the octane value of the unleaded gasoline is at least 92.

50. A method as defined in claim 3, 4, 5, 13, 15, 18, 22, 26, or 38 wherein the paraffin content of the unleaded gasoline is greater than 72 volume percent.

51. A method as defined in claim 50 wherein the octane value of the unleaded gasoline is at least 92.

52. A method as defined in claim 50 wherein the 10% D-86 distillation point of the unleaded gasoline is less than 140° F.

53. A method as defined in claim 50 wherein the Reid Vapor Pressure of the unleaded gasoline is less than 7.0 psi.

54. A method as defined in claim 53 wherein the 10% D-86 distillation point of the unleaded gasoline is no more than 135° F.

55. A method as defined in claim 3, 4, 12, 15, 16, 18, 24, or 38 wherein the paraffin content of the unleaded gasoline is greater than 75 volume percent.

56. A method as defined in claim 55 wherein the Reid Vapor Pressure of the unleaded gasoline is less than 7.0 psi.

57. A method as defined in claim 56 wherein the octane value of the unleaded gasoline is at least 92.

58. A method as defined in ciaim 57 wherein the 10% D-86 distillation point of the unleaded gasoline is no more than 135° F.

* * * * *

Disclaimer and Dedication

5,653,866—Peter J. Jessup; Michael C. Croudace, both of Santa Ana, Calif. GASOLINE FUEL. Patent dated Aug. 5, 1997. Disclaimer and Dedication filed Aug. 11, 2005, by the assignee, Union Oil Company of California.

Hereby disclaims and dedicates to the Public, the term of this patent, subsequent to Aug. 10, 2005.

*(Official Gazette, October 18, 2005)*

Disclaimer and Dedication

5,653,866—Peter J. Jessup; Michel C. Croudace, both of Santa Ana, Calif. GASOLINE FUEL. Patent dated Aug. 5, 1997. Disclaimer and Dedication filed Aug. 11, 2005, by the assignee, Union Oil Company of California.

Hereby disclaims and dedicates to the Public, the term of this patent, subsequent to Aug. 10, 2005.

*(Official Gazette October 16, 2007)*